US008301051B2

(12) United States Patent
Ogiso et al.

(10) Patent No.: US 8,301,051 B2
(45) Date of Patent: Oct. 30, 2012

(54) FIXING DEVICE, IMAGE FORMING APPARATUS, AND METHOD OF CONTROLLING FIXING DEVICE

(75) Inventors: Toshio Ogiso, Toyonaka (JP); Shin Yamamoto, Sakai (JP)

(73) Assignee: Ricoh Company, Limited, Tokyo (JP)

( * ) Notice: Subject to any disclaimer, the term of this patent is extended or adjusted under 35 U.S.C. 154(b) by 521 days.

(21) Appl. No.: 12/461,883

(22) Filed: Aug. 27, 2009

(65) Prior Publication Data

US 2010/0054785 A1 Mar. 4, 2010

(30) Foreign Application Priority Data

Aug. 27, 2008 (JP) ..... 2008-218025

(51) Int. Cl.
*G03G 15/20* (2006.01)

(52) U.S. Cl. ..... 399/69; 399/33; 399/320; 399/328; 399/334

(58) Field of Classification Search ..... 399/33, 399/69, 324
See application file for complete search history.

(56) References Cited

U.S. PATENT DOCUMENTS

| | | | | |
|---|---|---|---|---|
| 4,994,852 | A * | 2/1991 | Matsuuchi et al. | 399/33 |
| 5,778,278 | A * | 7/1998 | Jeon | 399/33 |
| 6,097,904 | A * | 8/2000 | Tsuruno et al. | 399/33 |
| 6,816,688 | B2 * | 11/2004 | Takano | 399/69 |
| 6,920,294 | B2 * | 7/2005 | Takano | 399/69 |
| 7,266,314 | B2 * | 9/2007 | Takami | 399/33 |
| 2001/0017992 | A1 * | 8/2001 | Hayashi et al. | 399/68 |
| 2003/0185583 | A1 * | 10/2003 | Senda | 399/69 |
| 2003/0215255 | A1 * | 11/2003 | Kinouchi et al. | 399/69 |
| 2006/0088329 | A1 * | 4/2006 | Suzuki et al. | 399/69 |
| 2006/0147221 | A1 * | 7/2006 | Asakura et al. | 399/69 |
| 2007/0047990 | A1 * | 3/2007 | Lemaster et al. | 399/69 |
| 2007/0140752 | A1 | 6/2007 | Yamamoto et al. | |
| 2007/0172278 | A1 | 7/2007 | Yamamoto | |
| 2007/0183798 | A1 * | 8/2007 | Moriguchi et al. | 399/33 |
| 2007/0189795 | A1 * | 8/2007 | Chae et al. | 399/69 |
| 2007/0242959 | A1 * | 10/2007 | Aono et al. | 399/13 |
| 2008/0013993 | A1 | 1/2008 | Obata et al. | |
| 2008/0056783 | A1 | 3/2008 | Yamamoto et al. | |
| 2008/0069611 | A1 | 3/2008 | Obata et al. | |
| 2008/0193162 | A1 | 8/2008 | Yamazoe et al. | |
| 2008/0260404 | A1 * | 10/2008 | Takagi et al. | 399/67 |
| 2009/0110418 | A1 | 4/2009 | Ogiso et al. | |
| 2009/0196643 | A1 * | 8/2009 | Mito et al. | 399/69 |
| 2009/0226202 | A1 * | 9/2009 | Kinouchi et al. | 399/69 |
| 2009/0257769 | A1 * | 10/2009 | Miyazaki | 399/69 |
| 2009/0290893 | A1 | 11/2009 | Ogiso et al. | |

FOREIGN PATENT DOCUMENTS

JP 11-191481 7/1999

(Continued)

OTHER PUBLICATIONS

Machine translation of JP2009-122499.*

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

In a fixing apparatus, an internal temperature detection device is arranged within a heat generation region and detects temperature of a fixing device. An external temperature detection device is arranged at the outside of the heat generation region and detects temperature of the fixing device. Heat generation in the heat generating device is stopped when temperature reaches a prescribed first high temperature detection limit and a temperature rising amount in a prescribed time period after the first high temperature detection limit is reached exceeds a prescribed threshold.

15 Claims, 14 Drawing Sheets

FOREIGN PATENT DOCUMENTS

| | | |
|---|---|---|
| JP | 2002-148999 | 5/2002 |
| JP | 2003-043853 | 2/2003 |
| JP | 2004-219871 | 8/2004 |
| JP | 2007-248690 | 9/2007 |
| JP | 2007-279636 | 10/2007 |
| JP | 2009-122499 | 6/2009 |

* cited by examiner

FIG. 20

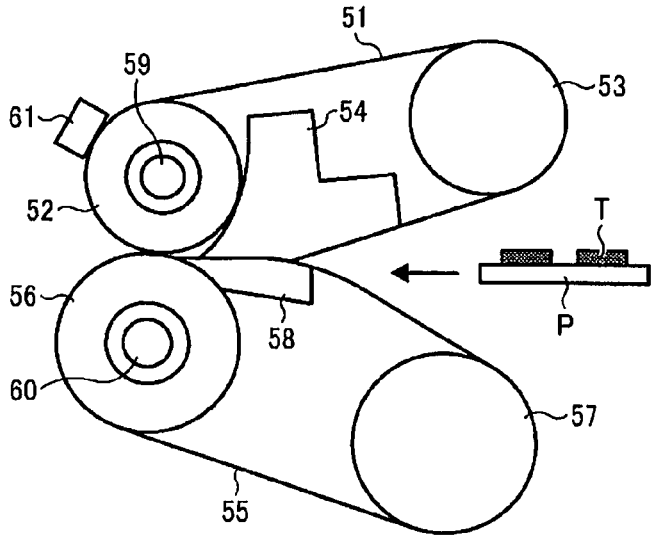

FIG. 21

TABLE 1

| | |
|---|---|
| SECOND HIGH TEMPERATURE DETECTION LEVEL IN WARM-UP CONDITION T2a | 160°C (=220°C−60°C) |
| SECOND HIGH TEMPERATURE DETECTION LEVEL IN STANDBY STATE T2b | 170°C (=220°C−50°C) |
| SECOND HIGH TEMPERATURE DETECTION LEVEL DURING FIXING OPERATION T2c | 180°C (=220°C−40°C) |

TABLE 2

| | TEMPERATURE RISING INCLINATION | PRESCRIBED TIME PERIOD $\Delta t_2$ | SECOND TEMPERATURE RISING AMOUNT THRESHOLD $\Delta T2$ |
|---|---|---|---|
| REST TIME | 9deg/s | 2s | 17deg |
| DURING ROTATION | 2deg/s | 5s | 9deg |

FIXING DEVICE, IMAGE FORMING APPARATUS, AND METHOD OF CONTROLLING FIXING DEVICE

CROSS REFERENCE TO RELATED APPLICATION

This application claims priority under 35 USC §119 to Japanese Patent Application No. 2008-218025, filed on Aug. 27, 2008, the entire contents of which are herein incorporated by reference.

BACKGROUND OF THE INVENTION

1. Field of the Invention

The present invention relates to a fixing device for fixing an image by heating a printing medium, and an image forming apparatus, such as a copier, a printing, a fax, a multifunctional machine, etc., employing the fixing device, and a control method of controlling the fixing device.

2. Discussion of the Background Art

In the conventional image forming apparatus, there is widely provided a fixing device for fixing an image by heating a toner image transferred onto a printing sheet. The fixing device generally includes a rotational fixing member, a heat generating member for heating the fixing member, and a pressurizing member for applying pressure to the fixing member. Temperature of the fixing member is appropriately controlled to maintain an optimum target level, so that the toner image on the printing sheet can be fixed when the printing sheet passes through a pressure contact section in which the fixing member and the pressurizing member pressure contact each other.

In the above-mentioned fixing device, when a problem, such as short-circuiting, etc., occurs in a control element (e.g. a triac) controlling a heater serving as a heat generating member, heat application by means of the heater becomes uncontrollable, and temperature of a prescribed member heated by the heater sometimes extraordinarily increases. In such a situation, the fixing device is possibly damaged. Then, the fixing device employs a device for detecting such an extraordinary high temperature to forcibly turn off power supply to the heater when detecting thereof.

However, when temperature rise is erroneously detected as being extraordinarily high (i.e. high temperature abnormality) in a normal operation, usability is spoiled. Thus, high temperature abnormality is desirously reliably detected during the normal operation.

For example, as discussed in the Japanese Patent Application Laid Open No. 11-191481, when prescribed high temperature is detected, power is not immediately stopped supplying to the heater, and is stopped only when the high temperature is exceeded and maintained for a prescribed time period thereafter. Thus, even if the prescribed high temperature is temporarily reached by over shooting during the normal operation, it is not regarded as high temperature abnormality.

Further, a fixing device described in the Japanese Patent Application Laid Open No. 2004-219871 has two steps of detecting prescribed high temperature. Specifically, when a condition in that a prescribed lower side high temperature is exceeded and kept for more than a prescribed time period, alarm is initially generated. When a prescribed higher side high temperature is detected, power is not immediately stopped supplying to a heater, and is stopped only when the prescribed higher side high temperature is exceeded and maintained for more than a prescribed time period thereafter.

Thus, similar to the fixing device of the Japanese Patent Application Laid Open No. 11-191481, the Japanese Patent Application Laid Open No. 2004-219871 prevents temperature rise from being regarded as high temperature abnormality in the ordinary operation.

However, the Japanese Patent Application Laid Open Nos. 11-191481 and 2004-219871 are possibly incapable of detecting the high temperature abnormality when a thermistor or the like arranged to detect the same is rarely malfunctioned due to an accident, such as imperfect short circuitry, etc.

SUMMARY OF THE INVENTION

Accordingly, an object of the present invention is to improve such background arts technologies and provides a new and novel fixing apparatus. Such as new and novel fixing apparatus includes a rotatable fixing device for fixing a toner image onto a printing medium with heat and pressure at a pressure contacting section, and a heat generating device for generating and applying heat to the fixing device. The heat generating device has a heat generation section extending in a widthwise direction of the fixing device. A pressurizing device is provided to pressure contact the fixing device at the pressure contacting section. An internal temperature detection device is arranged within a heat generation region corresponding to the heat generation section and detects temperature of the fixing device. An external temperature detection device is arranged at the outside of the heat generation region and detects temperature of the fixing device. A temperature control device is provided to control the heat generating device to approximate the temperature of the fixing device to a target level based on the temperature detected by the internal temperature detection device. Heat generation in the heat generating device is stopped one of when temperature detected by the internal temperature detection device reaches a prescribed first high temperature detection limit and a temperature rising amount in a prescribed time period after the first high temperature detection limit is reached exceeds a prescribed threshold, and when temperature detected by the external temperature detection device reaches a prescribed second high temperature detection limit, a temperature rising amount detected in a prescribed time period after the second high temperature detection limit is reached exceeds a prescribed threshold, and the heat generating device continuously generates heat on the maximum heat generation condition for a prescribed time period within the second prescribed time period.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 20 is a schematic cross sectional view illustrating a fixing device employing a fixing belt and a pressurizing belt.

FIG. 21 shows tables of an exemplary temperature rising inclinations changes in accordance with a configuration of the fixing device.

DESCRIPTION OF THE PREFERRED EMBODIMENTS

Figure 1:
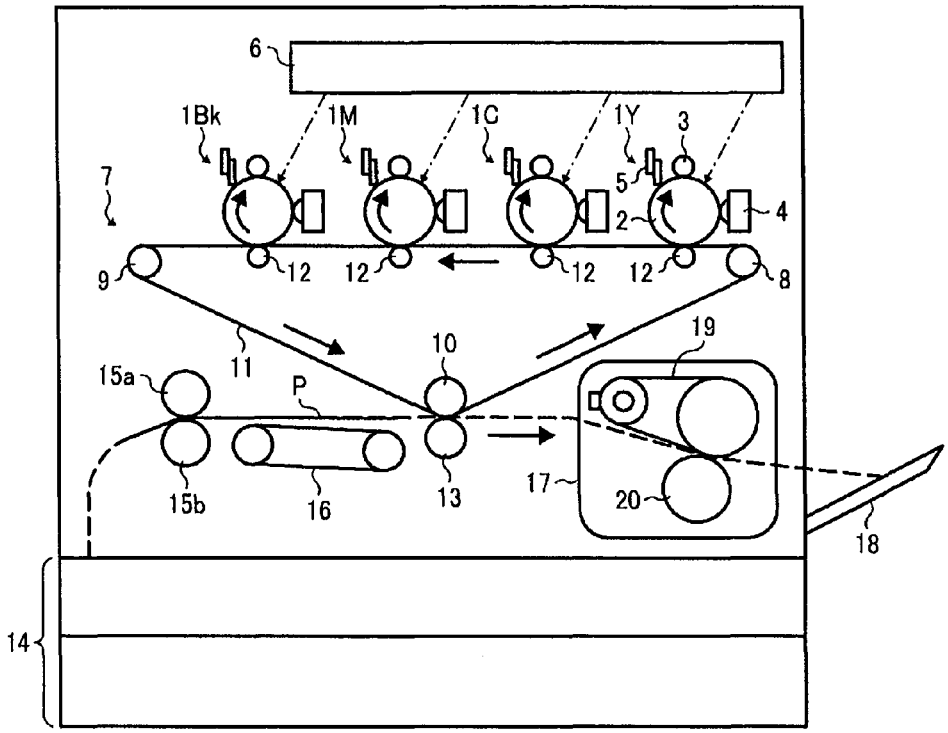
FIG. 1 is a schematic cross sectional view illustrating an image forming apparatus according to a first embodiment of the present invention.

Referring now to the drawing, wherein like reference numerals designate identical or corresponding parts throughout several views in particular in FIG. 1, an image forming apparatus is described. As shown, the image forming apparatus includes four image formation sections 1Y to 1Bk for forming images using different color developer of Yellow to Black corresponding to resolution color components of a color image.

The image formation sections 1Y to 1Bk have the substantially same configuration containing different color toner, respectively. Then, an exemplary configuration of only the image formation section 1Y is typically described hereinafter.

The image formation section 1Y includes a photoconductive member 2 for carrying a latent image as an image bearer, a charge device 3 for charging the surface of the photoconductive member 2, a developing device 4 for forming a toner image on the surface of the photoconductive member 2, and a cleaning device 5 for cleaning the surface 3 of the photoconductive member 2 or the like. The cleaning device 5 can be a cleaning blade, a cleaning roller, and a cleaning brush. A combination of these can be used.

Above the image formation sections 1Y to 1Bk, an exposure device 6 is arranged for forming latent images on the surface of the photoconductive members 2. An intermediate transfer unit 7 is arranged below the image formation sections 1Y to 1Bk.

The intermediate transfer unit 7 includes an intermediate transfer belt 11 suspended by plural suspension rollers 8 to 10. The intermediate transfer belt 11 includes at least one layer of an elastic coat on a surface of an endless belt substrate. The endless belt substrate can include resin, rubber, and metal thin plate or the like. The elastic coat layer may be made of resin, rubber, and elastomer or the like.

Four primary transfer rollers 12 pressure contact the four photoconductive members 2 via the intermediate transfer belt 11, respectively. Thus, the four photoconductive members 2 pressure contact the outer circumferential surface of the intermediate transfer belt 11 at pressure contact sections and form primary transfer nips, respectively. A secondary transfer roller 13 is also arranged opposing one of the plural suspension rollers 10. The secondary transfer roller 13 pressure contacts the outer circumferential surface of the intermediate transfer belt 11 at a pressure contact section and forms a second transfer nip.

Below the image forming apparatus, a printing medium supplying section 14 is arranged. The printing medium supplying section 14 includes a cassette capable of accommodating and stacking plural printing mediums, such as a printing sheet, an OHP film, etc., and a supplying roller or the like, not shown, for launching the printing medium.

A pair of registration rollers 15*a* and 15*b*, a printing medium conveyance unit 16 having a conveyance belt, and the fixing device 17 are arranged between the printing medium supplying section 14 and the intermediate transfer unit 7. The fixing device 17 includes an endless fixing belt 19 suspended around plural rollers as a fixing device and a pressurizing roller 20 pressure contacting the fixing belt 19. A fixing nip is formed at a pressure contact section where the pressurizing roller 20 pressure contacts the fixing belt 19. Further, on an external wall of a body of the image forming apparatus, a sheet ejection tray 18 is attached for placing ejected printing mediums in stock.

Now, an essential operation of the above-mentioned image forming apparatus is described with reference to FIG. 1. Initially, an operation of the image formation section 1Y is typically described. The charge device 3 uniformly charges the surface of the photoconductive member 2 rotating in a direction as shown by an arrow in the drawing to provide a high potential. A laser beam is emitted from the exposure device 6 to the surface of the photoconductive member 2 in accordance with image data, and the potential of a section receiving the emission decreases and thereby forming a latent image. Toner with the charge is electrostatically transferred by the developing device 4 onto the latent image on the surface of the photoconductive member 2, thereby a yellow toner image is formed (i.e., visualized).

A voltage receiving either a constant voltage (or current) control having a charge polarity opposite to that of the toner is applied to the primary transfer roller 12. Thus, a transfer electric field is created in the primary transfer nip between the primary transfer roller 12 and the photoconductive member 2. Then, in the primary transfer nip, the toner image on the rotating photoconductive member 2 is transferred onto the rotating intermediate transfer belt 11 in the direction as shown by an arrow in the drawing.

Similarly, in the rest of the respective image formation sections 1C to 1Bk, toner images are formed on the photoconductive members 2 and are transferred onto the intermediate transfer belt 11 to overlap one after another. Thus, a combined toner image of superimposition of the four-color toner images is formed on the intermediate transfer belt 11.

Each of the cleaning devices 5 removes toner remaining on the surface of the photoconductive member 2 after the primary transfer process. Then, a charge removing lamp or the like, not shown, removes electric charge remaining on the photoconductive member 2.

Further, a supply roller in the printing medium supply section 14 is rotated and launches a printing medium P. The printing medium P launched from the printing medium supply section 14 temporarily stops at a pair of registration rollers 15*a* and 15*b*.

Further, a transfer electric field is created in the second transfer nip formed between the secondary transfer roller 13 and the roller 10 opposing thereto by applying a voltage having a polarity opposite to a charge polarity of toner to a second transfer roller 13. The similar transfer electric field can be created by applying a voltage having the same polarity as the charge polarity of the toner to the roller 10 opposing the secondary transfer roller 13. Then, the registration rollers 15*a* and 15*b* are driven again and convey the printing medium P to the secondary transfer nip in synchronism with the combined toner image on the intermediate transfer belt 11. Then, the combined toner image on the intermediate transfer belt 11 is transferred onto the printing medium P at once as second transfer in the transfer electric field created in the second transfer nip.

The printing medium P with the combined toner image transferred thereonto is then conveyed to the fixing device 17. The printing medium P is then transferred into the fixing nip formed between the fixing belt 19 and the pressurizing roller 20. During passage of the printing medium P through the fixing nip, toner of the combined toner image is melt and fixed onto the printing medium P. Then, the printing medium P with combined toner image being fixed is ejected onto the sheet ejection tray 18 and is placed in stock.

Figure 2:
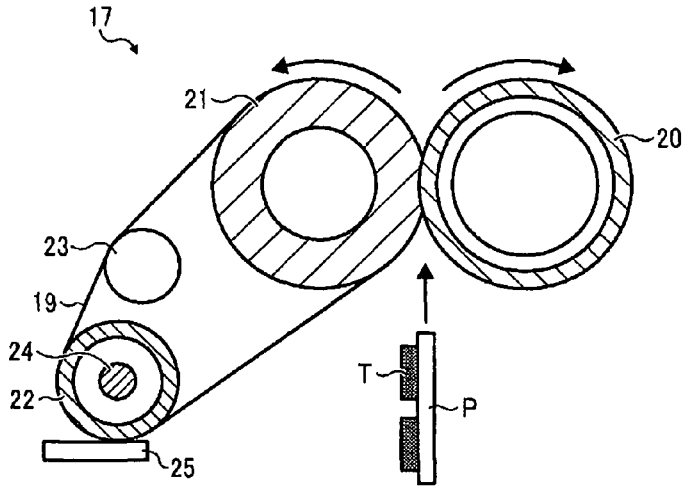
FIG. 2 is a schematic cross sectional view illustrating a fixing device included in the image forming apparatus of FIG. 1.

Now, an exemplary fixing device according to the first embodiment is described more in detail. As shown in FIG. 2, the fixing device 17 includes an endless fixing belt 19 serving as a fixing device, a pressurizing roller 20 for applying pressure to the fixing belt 19, a fixing roller 21 opposing the pressurizing roller 20, a heating roller 22 having a heater 24 as a heat applying device for applying heat to the fixing belt 19, and plural suspension rollers 23.

The fixing belt 19 is suspended by the fixing roller 21, the heating roller 22, and the suspension rollers 23. The pressurizing roller 20 pressure contacts the fixing belt 19 opposing the fixing roller 21, and driven rotates the fixing belt 19 as it rotates. As mentioned above as to the essential operation, by conveying the printing medium P that carries a unfixed toner image T through the pressure contact section (i.e., a fixing nip) where the pressurizing roller 20 and the fixing belt 19 pressure contacts each other, the toner image T on the printing medium P is fixed. Further, a temperature detection device 25 is arranged opposing the heating roller 22 on the side of the outer circumferential surface of the fixing belt 19.

Figure 3:
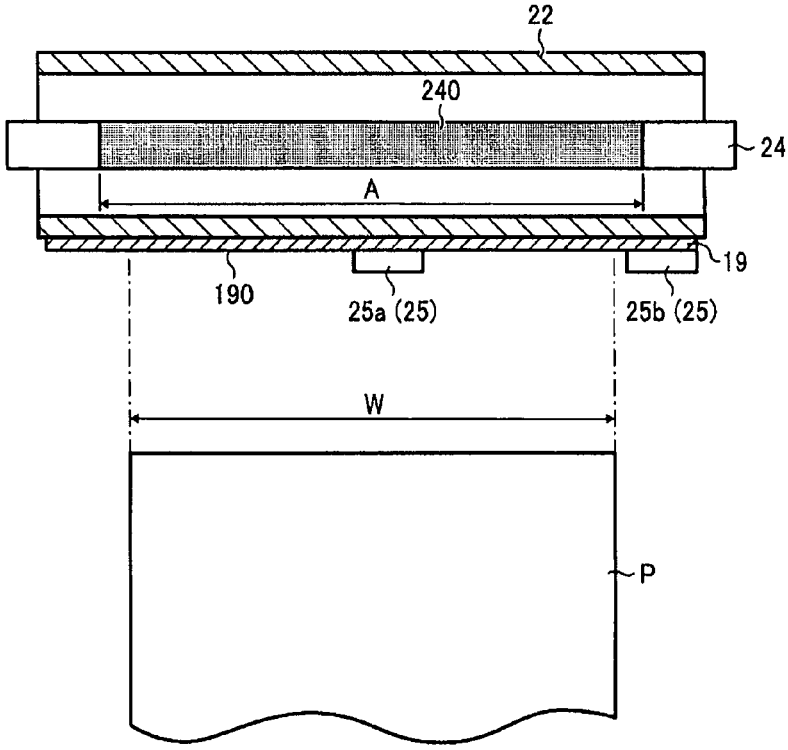
FIG. 3 is a schematic cross sectional view illustrating a heating roller.

Now, an exemplary heating roller 22 included in the fixing device of FIG. 2 is described with reference to FIG. 3. As shown in FIG. 3, the heater 24 installed in the heating roller 22 includes a heat generation section 240 arranged in a widthwise direction of a rotation surface 190 of the fixing belt 19. In the drawing, "W" represents a passage region where the printing medium P passes through. The heat generation section 240 is arranged corresponding to the passage region W.

As shown, the temperature detection device 25 includes a first temperature detection device 25*a* and a second temperature detection device 25*b*. The first temperature detection device 25*a* is arranged within a widthwise region A where the heat generation section 240 is arranged. The second temperature detection device 25*b* is arranged at the outside of the widthwise region A. In other words, the first temperature detection device 25*a* is arranged within the passage region W where a printing medium P passes through, while the second temperature detection device 25*b* is arranged at the outside of the passage region W, where the printing medium P does not pass through. The first temperature detection device 25*a* is herein below referred to as an internal temperature detection device and the second temperature detection device 25*b* is referred to as an external temperature detection device. However, the external temperature detection device 25*b* is not limited to that always arranged at the outside but includes a modification partially arranged within the widthwise region A.

Further, a contact type temperature detection device, such as a thermistor, etc., for detecting temperature of the fixing belt 19 by contacting thereto is employed in each of the internal and external temperature detection devices 25*a* and 25*b*. Instead of the contact type, a non contact type temperature detection device, such as thermopile, etc., for detecting temperature of the fixing belt 19 by separating therefrom is employed in each of the internal and external temperature detection devices 25*a* and 25*b*.

Figure 4:
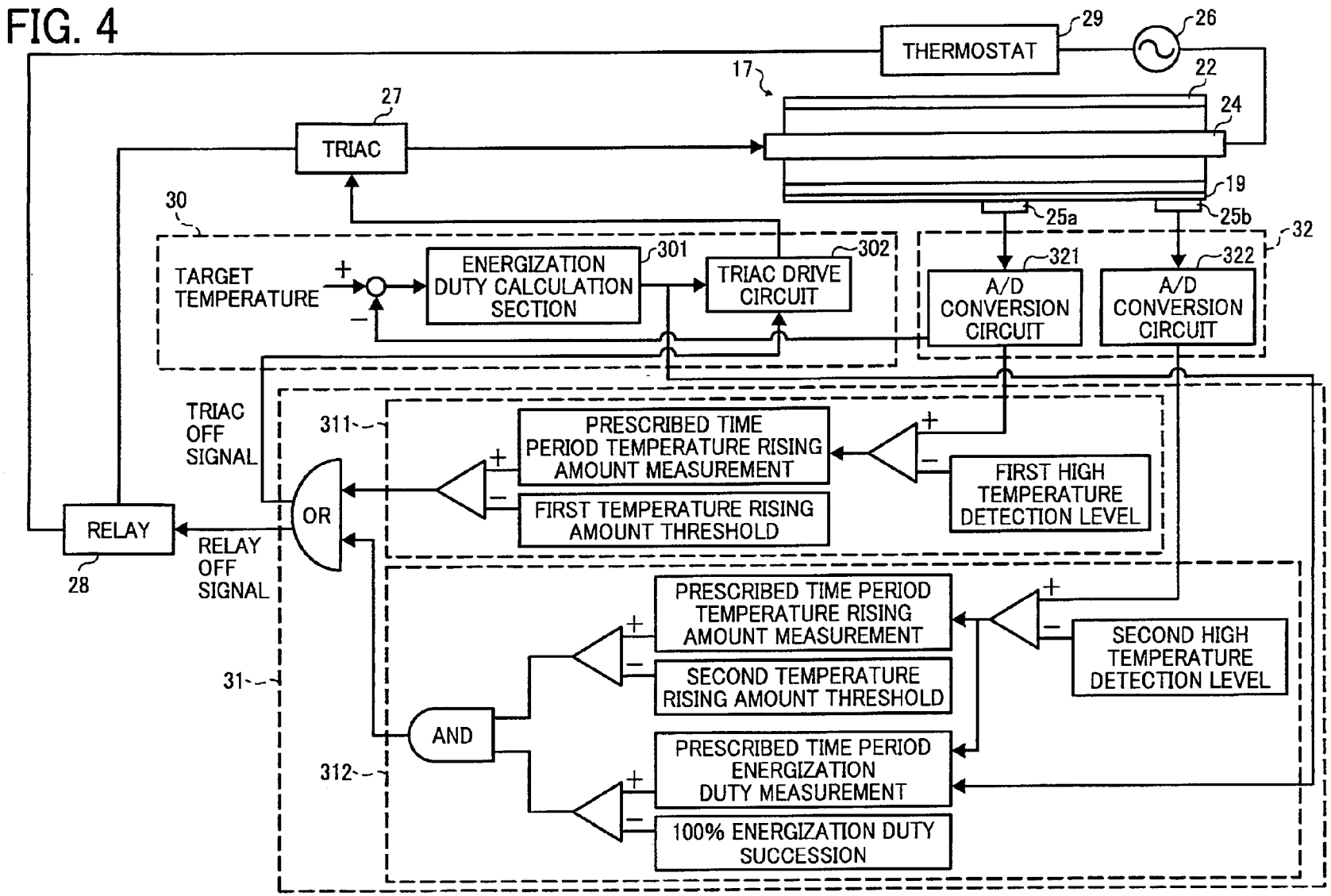
FIG. 4 is a block chart illustrating a control system for the fixing device.

Now, an exemplary control system for controlling temperature of a fixing device 17 is described with reference to FIG. 4. As shown, in a power supply circuit of the heater 24, an AC power supply 26 and a heat generation stopping device including a triac 27, a relay 28, and a thermostat 29 to shut off the power supply distributed to the heater 24 from the AC power supply 26 are arranged. In the power supply circuit, a temperature control section 30 that controls temperature of the fixing belt 19 to approach an optimal level of fixing, and a detection signal processing section 32 that processes temperature detection signals generated by the internal and external temperature detection devices 25*a* and 25*b* are arranged.

The temperature control section 30 includes a power distribution duty calculation section 301 for calculating a power distribution duty based on a difference between a temperature detected by the internal temperature detection device 25*a* per prescribed cycle and a target temperature. The power distribution duty represents a ratio of a power distribution period to an hour when the power is distributed to the heater 24. The power distribution duty calculation section 301 is connected to the internal temperature detection device 25*a* via an A/D conversion circuit 321 included in the detection signal processing section 32. Thus, a temperature detection signal detected by the internal temperature detection device 25*a* is subjected to digital conversion by the A/D conversion circuit 321 and is inputted to the power distribution duty calculation section 301. The temperature control section 30 includes a triac drive circuit 302 for turning on and off the triac 27 based on power distribution duty calculated by the power distribution duty calculation section 301. Since the triac driving circuit 302 turns on and off the triac 27 based on the power distribution duty, power distribution to the heater 24 is controlled and temperature of the fixing belt 19 can approach the optimum target level suitable for fixation.

However, when the heater 24 becomes uncontrollable due to electric shorting of the triac 27 or the like, a prescribed member is heated by the heater 24 to an extraordinarily high level and fixing and image forming devices are possibly damaged. In order to prevent the damages caused by such high temperature abnormality, a high temperature abnormality detecting section 31 is arranged to detect high temperature abnormality in the power distribution circuit of the heater 24.

The high temperature abnormality detecting section 31 includes a first high temperature abnormality detecting section 311 for detecting high temperature abnormality based on temperature information detected by the internal temperature detection device 25*a* and a second high temperature abnormality detecting section 312 for detecting high temperature abnormality based on information related to power distribution duty and temperature information detected by the external temperature detection device 25*b*.

The first high temperature abnormality detecting section 311 is connected to the internal temperature detection device 25*a* via the A/D converter circuit 321 included in the detection signal processing section 32. Thus, a temperature detection signal detected by the internal temperature detection device 25*a* is subjected to digital conversion by the A/D conversion circuit 321 and is inputted to the first high temperature abnormality detecting section 311. The first high temperature abnormality detecting section 311 stores a prescribed first high temperature detection limit serving as reference for detecting high temperature abnormality and a first temperature rising amount threshold.

The second high temperature abnormality detecting section 312 is connected to the external temperature detection device 25*b* via the A/D conversion circuit 322 included in the detection signal processing section 32. Thus, a temperature detection signal detected by the external temperature detection device 25*b* is subjected to digital conversion by the A/D conversion circuit 322 and is inputted to the second high temperature abnormality detecting section 312. The second high temperature abnormality detecting section 312 stores a prescribed second high temperature detection limit serving as a reference for detecting high temperature abnormality and a second temperature rising amount threshold. The second high temperature abnormality detecting section 312 is connected to the power distribution duty calculation section 301 to receive information related to the power distribution duty therefrom. The first and second high temperature abnormality detecting sections 311 and 312 are enabled to transmit signals for turning off the triac 27 and the relay 28.

Now, an exemplary relation between the designated first and second high temperature detection limits T1 and T2 and temperatures detected by the internal and external temperature detection devices 25*a* and 25*b*, respectively, are described with reference to FIG. 5. As shown, a left side longitudinal axis represents temperature detected by the internal temperature detection device 25*a* and a right side longitudinal axis represents temperature detected by the external temperature detection device 25*b*.

As shown, the first high temperature detection limit T1 is set to 220 degree centigrade, for example, to be lower than a damaging temperature $T_{D\text{-}IN}$ of 330 degree centigrade, for example, detectable for the inner side temperature detection device 25*a*. The damaging temperature $T_{D\text{-}IN}$ causes irreversible damages onto the fixing device and/or the image forming apparatus due to its high temperature.

The second high temperature detection limit T2 is set based on the first high temperature detection limit T1. Specifically, the second high temperature detection limit T2 is obtained by subtracting a difference between temperatures detected by the internal and external detection devices 25*a* and 25*b* from the first high temperature detection limit T1. For example, when image formation is executed, detection temperature of the external temperature detection device 25*b* is lower than that of the internal temperature detection device 25*a* by 40 degree centigrade. Accordingly, when the first high temperature detection limit T1 is set to be 220 degree centigrade, T2 is set to be 180 degree centigrade, which is obtained by subtracting the difference of 40 degree centigrade between the detection temperatures of the temperature detection devices 25*a* and 25*b* from the T1 of 220 degree centigrade. Further, the thus set T2 is again lower than the damaging temperature $T_{D\text{-}OUT}$ for the fixing belt detectable for the external temperature detection device 25*b*.

Now, an exemplary change of temperature of the fixing belt is described with reference to FIG. 6. As shown, a solid line $T_{IN}$ represents temperature change detected by the internal temperature detection device 25*a* as time elapses, while a two dotted line $T_{OUT}$ represents temperature change detected by the external temperature detection device 25*b* as time elapses. The temperature $T_{IN}$ detected by the internal temperature detection device 25*a* represents temperature of a prescribed portion of the fixing belt, which is readily heated up by the heater. Whereas, the temperature $T_{OUT}$ detected by the external temperature detection device 25*b* represents temperature of a portion other than the prescribed portion readily heated up by the heater. Accordingly, as shown there, the temperature $T_{OUT}$ is usually detected lower than that of $T_{IN}$.

Now, an exemplary control method of controlling the fixing device is described with reference to FIG. 7 in addition to FIGS. 4 and 6.

Information of temperature $T_{IN}$ detected by the internal temperature detection device 25*a* is inputted to the first high temperature abnormality detecting section 311 and is examined if being high temperature abnormality. Information of temperature Tout detected by the external temperature detection device 25*b* is inputted to the second high temperature abnormality detecting section 312 and is examined if being high temperature abnormality. These high temperature abnormality detections are executed simultaneously by the first and second high temperature abnormality detecting devices 311 and 312. Initially, an operation of the first high temperature abnormality detecting section 311 is described.

The first high temperature abnormality detecting section 311 determines if temperature $T_{IN}$ reaches the prescribed first high temperature detection limit T1 upon its input in step S11. When the determination is negative, the $T_{IN}$ is determined as not being high temperature abnormality, and power distribution to the heater 24 is not stopped. When the $T_{IN}$ largely increases than the target temp T0 and reaches the first high temperature detection limit T1 for some reason as shown in FIG. 6, the first high temperature abnormality detecting section 311 then detects an amount of temperature rising amount delta Tin in a prescribed time period delta t1 in step S12. The first high temperature abnormality detecting section 311 determines if the temperature rising amount delta Tin exceeds a previously set first temperature rising amount threshold delta T1 in step S13. When the temperature rising amount delta $T_{IN}$ does not exceed the first temperature rising amount threshold delta T1, it is regarded as not being high temperature abnormality and power distribution to the heater 24 is not stopped. Whereas when the temperature rising amount delta $T_{IN}$ exceeds the first temperature rising amount threshold delta T1 as shown in FIG. 6, it is regarded as being the high temperature abnormality, and the first high temperature abnormality detecting section 311 transmits a signal for turning off the triac 28 and the relay 28 and stops power distribution to the heater 24 in step S19.

As mentioned above, the first high temperature abnormality detection section 311 only detects (and recognizes the high temperature abnormality) when the temperature rising amount delta $T_{IN}$ exceeds the first temperature rising amount threshold delta T1 after detecting the first high temperature detection limit T1. Specifically, the first high temperature abnormality detecting section 311 is prohibited to detect the high temperature abnormality only based on the detection of the first high temperature detection limit T1. Thus, even when temperature of the fixing belt temporarily reaches the first high temperature detection limit T1 due to an accident during the normal operation, the first high temperature detection limit T1 is avoided from being erroneously detected as high temperature abnormality.

Figure 6:
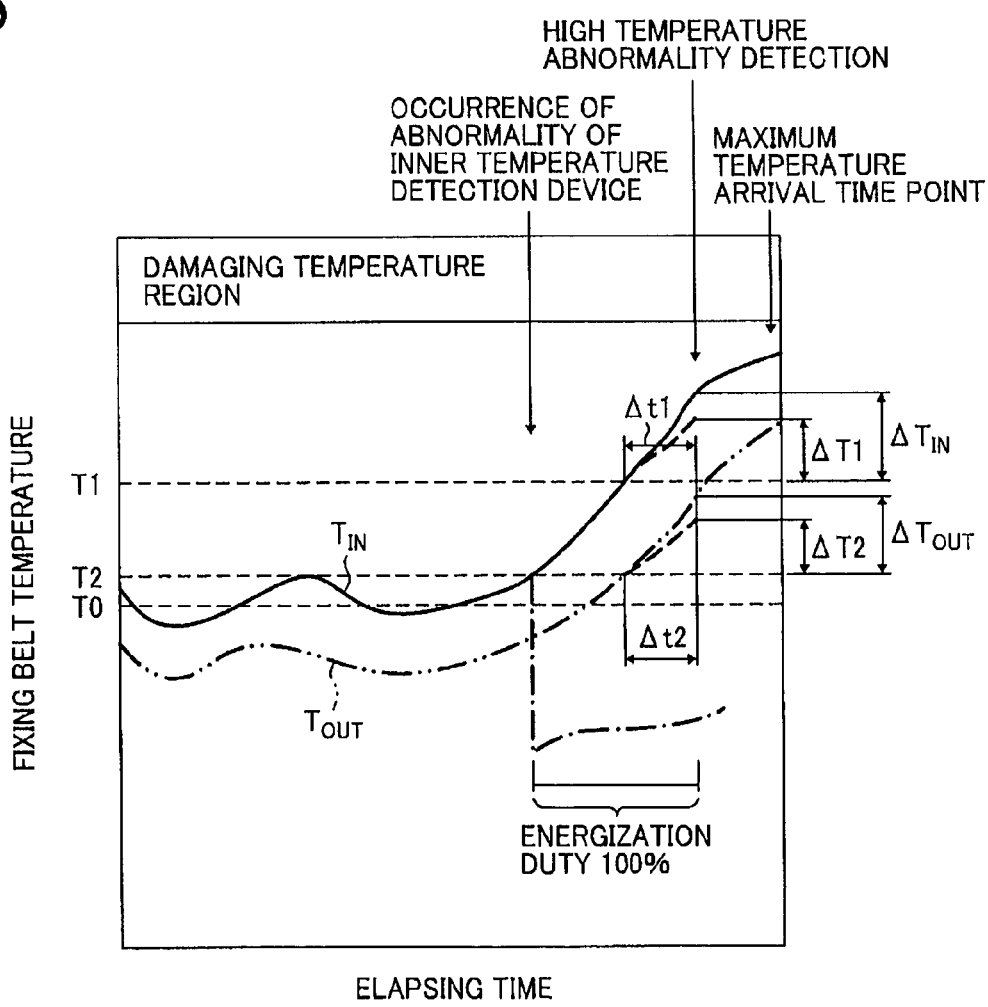
FIG. 6 is a graph illustrating a change of temperature of a fixing belt.
Figure 7:
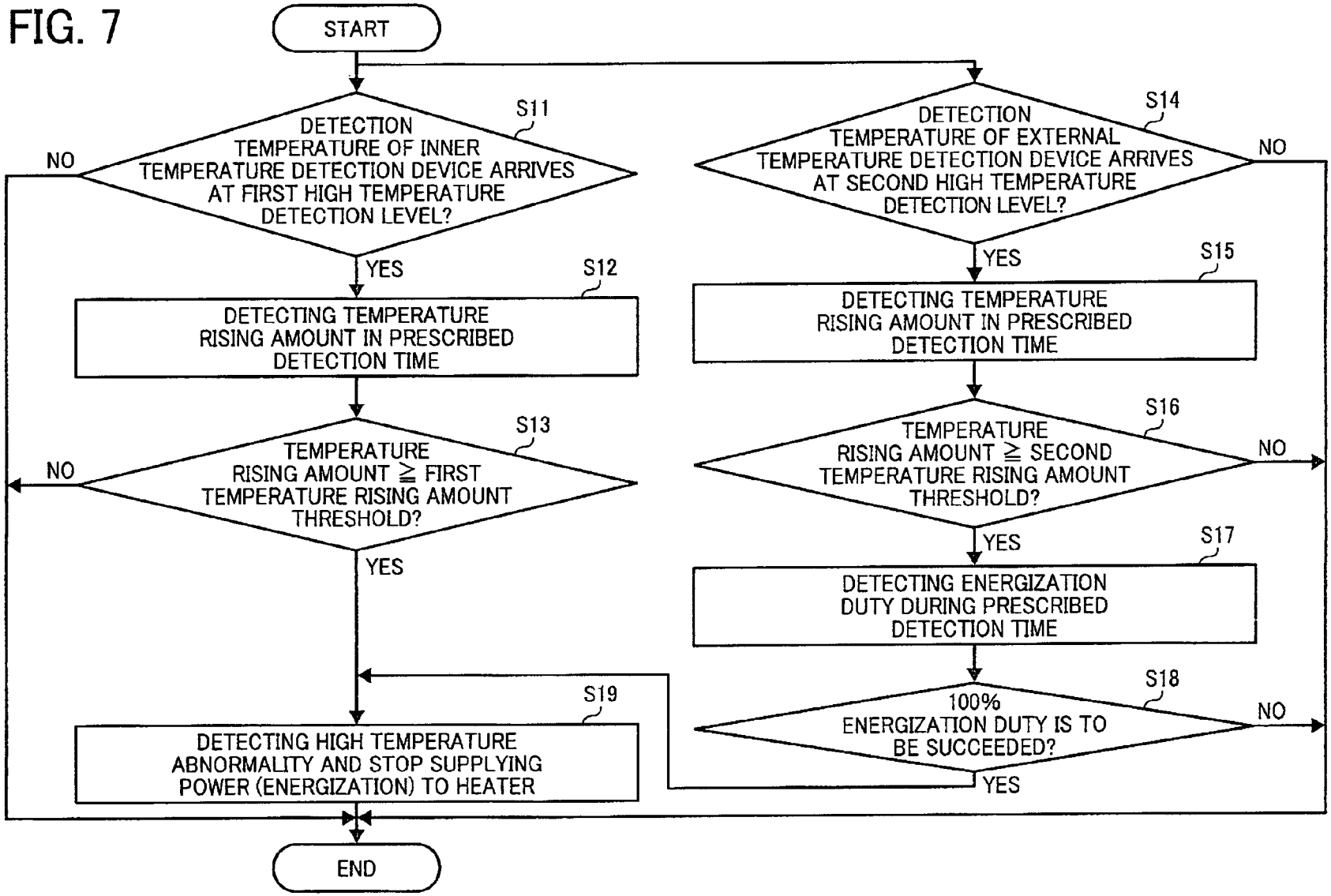
FIG. 7 is a flowchart illustrating a method of detecting high temperature abnormality according to the first embodiment.

Back to FIG. 6, a dotted line branching off from the temperature $T_{IN}$ shown by a solid line represents a variation of temperature per hour when abnormality, such as imperfect disconnection, etc., occurs in the internal temperature detection device 25*a*. In such a situation, since the abnormality occurs in the internal temperature detection device 25*a*, temperature detected by the internal temperature detection device 25*a* (as shown by the dotted line) is extraordinary lower than that to be detected under ordinary circumstances (as shown by the solid line). Then, due to such lower detection, the fixing device maintains power distribution duty in the 100% condition so as to approximate the temperature of the fixing belt to the target temperature T0. As a result, even though the temperature of the fixing belt highly rises after the abnormality occurs in the internal temperature detection device 25*a* as shown in FIG. 6, the first high temperature abnormality detecting section 311 cannot detect such high temperature abnormality.

Then, the second high temperature abnormality detecting section 312 detects such high temperature abnormality. Specifically, the second high temperature abnormality detecting section 312 determines if temperature Tout exceeds a second high temperature detection limit T2 in step S14 upon its input. When the determination is negative, the Tout is determined as not being high temperature abnormality, and power distribution to the heater 24 is not stopped. Whereas when the $T_{OUT}$ reaches the second high temperature detection limit T2, the second high temperature abnormality detecting section 312 then detects a temperature rising amount delta $T_{OUT}$ in a prescribed time period delta $t_2$ after the reaching thereof in step S15. The second high temperature abnormality detecting section 312 then determines if the delta Tout exceeds the second temperature rising amount threshold delta T2 in step S16. When the temperature rising amount delta Tout does not exceed the second temperature rising amount threshold delta T2, it is not regarded as high temperature abnormality and power distribution to the heater 24 is not stopped. Whereas when the temperature rising amount delta $T_{OUT}$ exceeds the second temperature rising amount threshold delta T2 as shown in FIG. 6, the second high temperature abnormality detecting section 312 detects power distribution duty for the heater during the above-mentioned detection time period delta $t_2$ in step S17. The second high temperature abnormality detecting section 312 then determines if the power distribution duty for the heater during the above-mentioned detection time period delta $t_2$ is maintained to be 100% in step S18. When the power distribution duty is not maintained to be 100% during the above-mentioned detection time period delta $t_2$, it is not regarded as the high temperature abnormality and power distribution duty to the heater 24 is not stopped. Whereas when the power distribution duty is maintained to be 100% during the above-mentioned detection time period delta $t_2$, the second high temperature abnormality detecting section 312 transmits a signal for turning off the triac 28 and the relay 28 and stops power distribution to the heater 24 in step S19.

Thus, even though the first high temperature abnormality detecting section 311 becomes unable to detect high temperature abnormality due to occurrence of the accident (i.e., abnormality) in the internal temperature detection device 25*a*, the second high temperature abnormality detecting section 312 can detect the high temperature abnormality. As a result, the power distribution to the heater 24 can be stopped, and temperature of the fixing belt does not reach the damaging level.

The second high temperature abnormality detecting section 312 can detect high temperature abnormality not only when the first high temperature abnormality detecting section 311 cannot detect high temperature abnormality, but also when the first high temperature abnormality detecting section 311 can detect high temperature abnormality.

Further, the temperatures $T_{IN}$ and $T_{OUT}$ of the fixing belt rise due to transmission of heat from the heater for a while even after high temperature abnormality is detected and the power distribution to the heater is stopped. Thus, the first and second high level temperature limits T1 and T2 are preferably set to prescribed levels so that the highest temperature of the fixing belt as shown in FIG. 6 does not exceed the damaging level due to the transmission of the heat from the heater after stopping of the power distribution to the heater.

Figure 5:
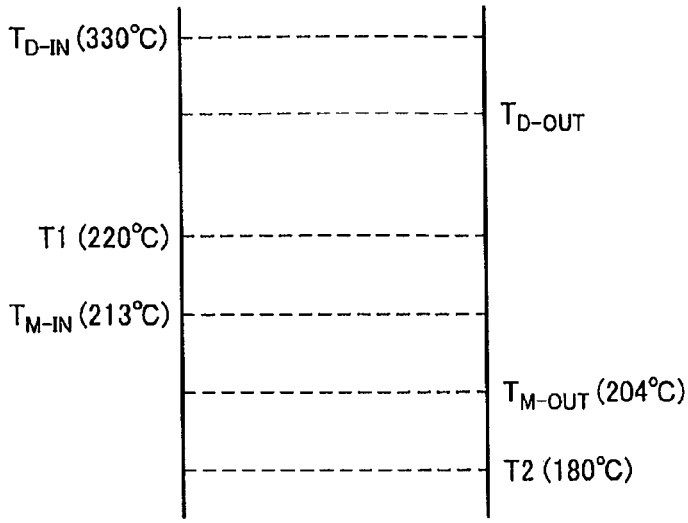
FIG. 5 is a chart schematically illustrating a relation between designated first and second high temperature detection limits and temperatures practically detected by internal and external temperature detection devices.

Further, as shown in FIG. 5, the second high temperature detection limit T2 (e.g. 180 degree centigrade) is set lower than the highest temperature $T_{M\text{-}OUT}$ (e.g. 204 degree centigrade) detectable for the external temperature detection device 25*b* during the normal operation. Thus, the second high temperature abnormality detecting section 312 is controlled to determine if a temperature rising amount delta Tout in a prescribed time period delta $t_2$ exceeds the second temperature rising amount threshold delta T2 only after detecting the second high temperature detection limit T2 not to erroneously detect as high temperature abnormality during the normal operation.

Further, when turning on and off of the power distribution to a heater is repeated during image formation operation or the like, a temperature ripple (i.e., up down variation of temperature) detected by the external temperature detection device 25*b* sometimes becomes larger. At this moment, when temperature rising of the ripple exceeds the second temperature rising amount threshold delta T2 in a prescribed detection time period delta $t_2$, it can erroneously be detected as being high temperature abnormality even during the normal operation. However, the second high temperature abnormality detecting section 312 determines if the power distribution duty is maintained as 100% during the above-mentioned detection time period delta $t_2$ not to execute erroneous detection during the normal operation.

Maintaining the maximum heat generation condition for the heater can also be detected by checking a voltage applied to a power distribution circuit or the like.

A duty check time period when the second high temperature abnormality detecting section 312 detects the power distribution duty can be partially overlapped with the above-mentioned prescribed detection time period delta $t_2$. However, in view of accurate detection of the high temperature abnormality, the duty check time period is preferably accords with the above-mentioned prescribed detection time period delta $t_2$.

Now, a second embodiment is described with reference to FIG. 8. As shown, outline configurations of an image forming apparatus and a fixing device are the same as those of the first embodiment as shown in FIGS. 1 to 4.

As described in the first embodiment, a second high temperature detection limit T2 is obtained and set by subtracting a difference between detection temperatures of internal and external temperature detection devices 25*a* and 25*b* from a first high temperature detection limit T1. The difference between temperatures detected by the internal and external temperature detection devices 25*a* and 25*b* varies in accordance with an operation condition of the fixing device, such as a first warm up condition when temperature of the fixing belt reaches a target level after power is supplied, and a second warm up condition when an instruction for starting a fixing operation is waited after the first warm up, a fixing operation execution condition, etc.

An exemplary temperature change of the fixing belt in the respective operation conditions is described with reference to FIG. 8. As shown, the detection temperature Ta-$_{OUT}$ of the external temperature detection device 25*b* in the first warm up condition is lower than the detection temperature $T_{IN}$ of the internal temperature detection device 25*a* by about 60 degree centigrade. The detection temperature Tb-out of the external temperature detection device 25*b* in the waiting time (second warm up) condition is lower than the detection temperature $T_{IN}$ of the internal temperature detection device 25*a* by about 50 degree centigrade. Further, the detection temperature Tc-out of the external temperature detection device 25*b* in the fixing operation execution condition is lower than the detection temperature Tin of the internal temperature detection device 25*a* by about 40 degree centigrade.

The fixing device designates a second high temperature detection limit T2 in accordance with a difference between temperatures detected by the internal and external temperature detection devices 25*a* and 25*b* in the respective of the warm up, the waiting time, and the fixing operation execution conditions. Exemplary second high temperature detection limits T2*a*, T2*b*, and T2*c* in the respective of the warm up, the waiting, and the fixing operation execution conditions are listed on the table 1.

Table 1 (See FIG. 21)

The respective of the second high temperature detection limits T2*a*, T2*b*, and T2*c* are obtained by subtracting the difference between detection temperatures of the internal and external temperature detection devices 25*a* and 25*b* in each of the respective of the warm up, the waiting time, and the fixing operation execution conditions from the first high temperature detection limit T1. For example, when the first high temperature limit T1 is 220 degree centigrade, the T2*a* in the warm up condition is obtained and set to 160 degree centigrade by subtracting the detection temperature difference of 60 degree centigrade from the T1 of 220 degree centigrade. The T2*b* in the waiting time condition is obtained and set to 170 degree centigrade by subtracting the detection temperature difference of 50 degree centigrade from the T1 of 220 degree centigrade. Similarly, the T2*c* in the fixing operation execution condition is obtained and set to 180 degree centigrade by subtracting the detection temperature difference of 40 degree centigrade from the T1 of 220 degree centigrade. Thus, these temperatures T2*a*, the T2*b*, and the T2*c* become larger in this order.

However, since the detection temperature difference varies depending on a configuration of a fixing device, the above-mentioned differences are changed appropriately. Thus, these temperatures T2*a*, the T2*b*, and the T2*c* in the respective operation conditions are preferably designated in accordance with a temperature detection difference and stored in the second high temperature abnormality detecting section 312.

Figure 9:
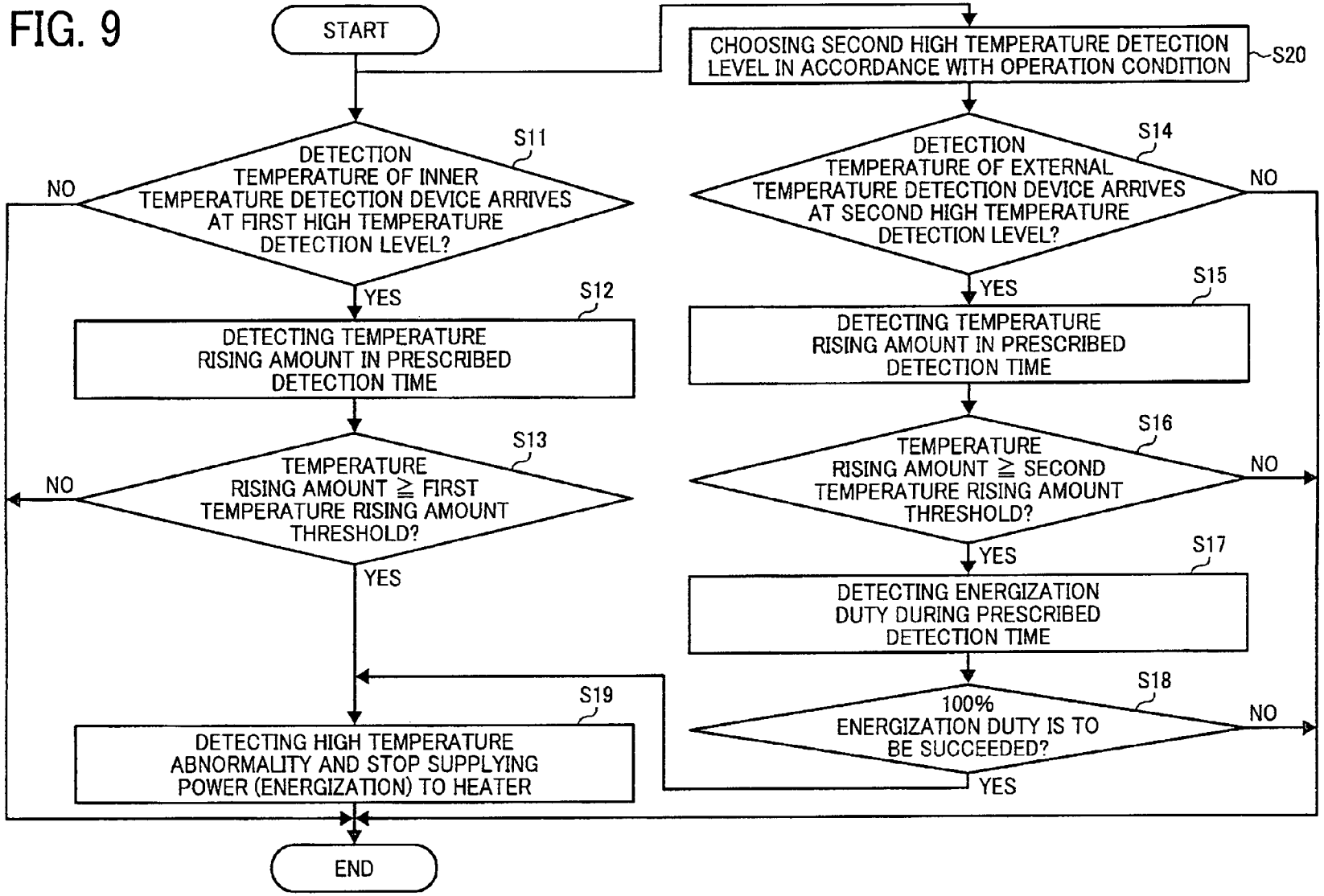
FIG. 9 is a flowchart illustrating a method of detecting high temperature abnormal according to a second embodiment of the present invention.

Now, an exemplary sequence of a high temperature abnormality detection system employed in the second embodiment is described with reference to FIG. 9.

The detection manner in this embodiment is different from that of the first embodiment as follows. In the second embodiment, the second high temperature detection limit is selected in accordance with an operation condition of the fixing device (e.g. warm up, waiting time, fixing operation executing conditions) in step S20. Specifically, as shown in the table 1, as the second high temperature detection limit, 160 degree centigrade, 170 degree centigrade, and 180 degree centigrade are selected in the respective warm up, waiting time, and fixing operation execution conditions. Then, it is determined if temperature of the fixing belt reaches the second high temperature detection limit selected in step S14. The rest of the sequence of detection of high temperature abnormality is similar to that of the first embodiment.

Figure 8:
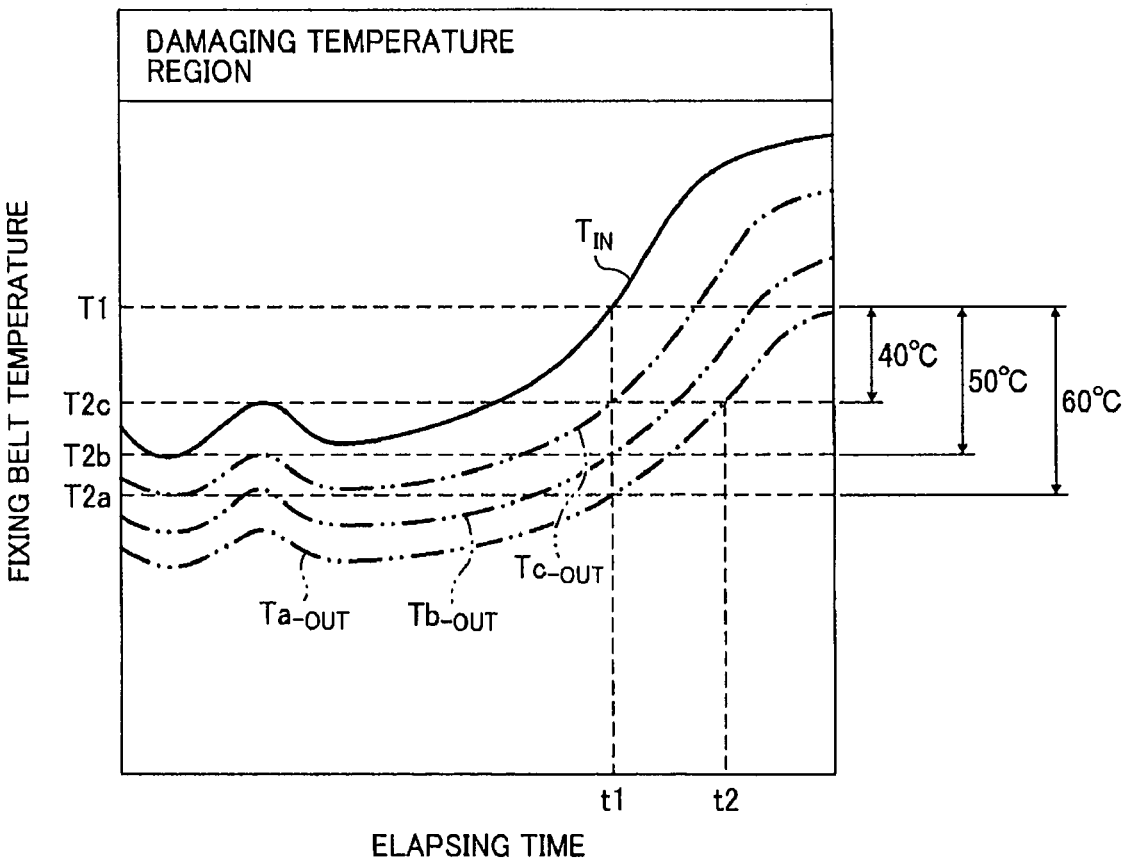
FIG. 8 is a graph illustrating a change of temperature of the fixing belt in each of warm up, waiting time, and fixing operation conditions.

In this way, since the temperatures T2*a*, T2*b*, and the T2*c* are set in accordance with the respective of the operation conditions of the fixing device, times when temperature of the fixing belt reaches the second high temperature detection limits T2*a*, T2*b*, and T2*c* can become substantially the same in the respective of operation conditions as shown by a time $t_1$ in FIG. 8.

However, when the second high temperature detection limit T2*c* in the warm up condition is designated as a detection temperature Ta-out in the fixing operation execution condition, the time when temperature of the fixing belt reaches the high temperature detection limit T2*c* (as shown by $t_2$ in FIG. 8) is delayed from the a time $t_1$. Thus, detection of high temperature abnormality is delayed and the temperature of the fixing belt possibly reaches the damaging level.

According to the second embodiment, even when the operation condition of the fixing device varies, the high temperature abnormality can be appropriately detected and power distribution to the heater can be stopped by automatically selecting the second high temperature detection limit in accordance with the operation condition thereof. Thus, temperature of the fixing belt does not reach the damaging level.

Figure 10:
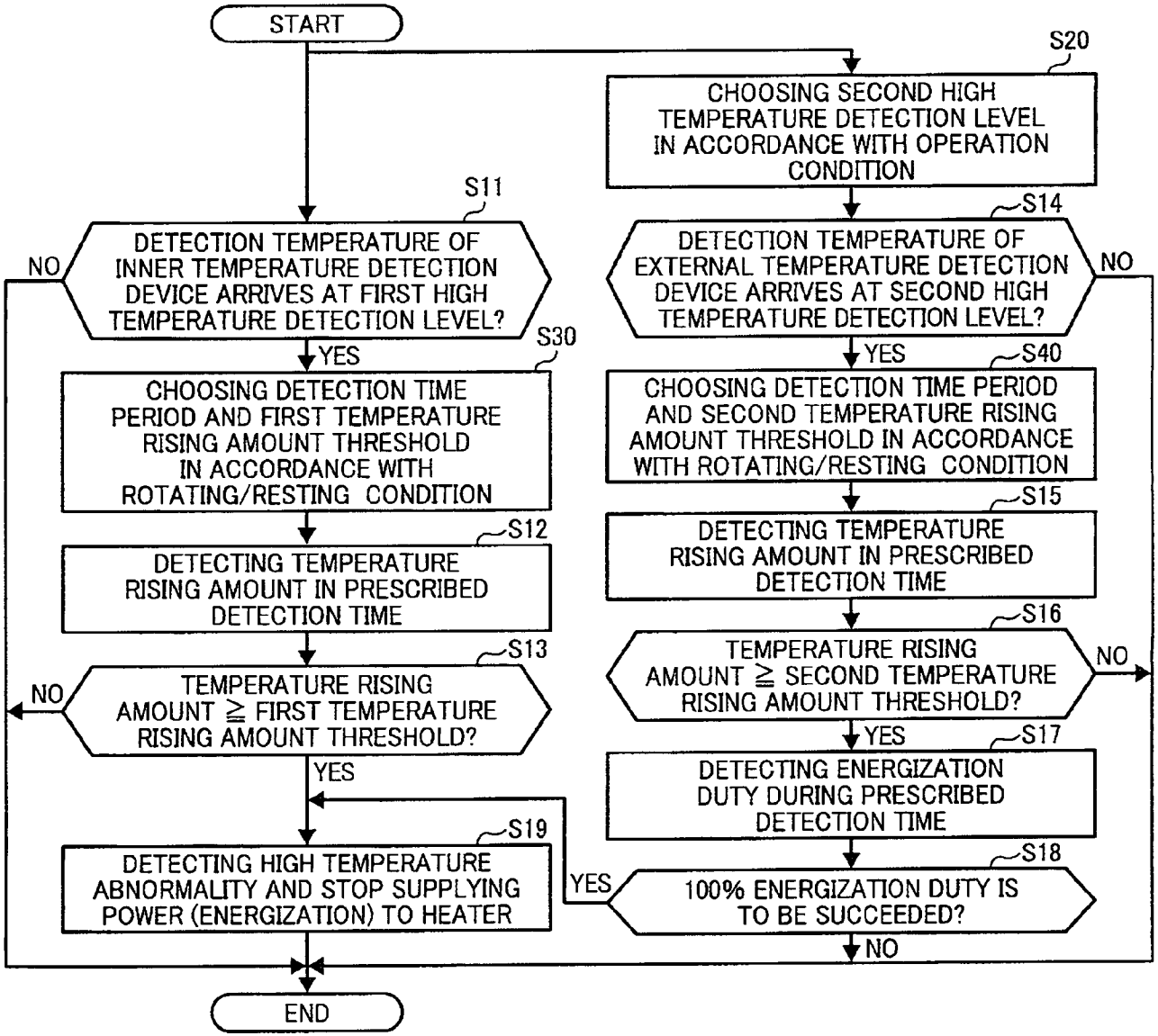
FIG. 10 is a flowchart illustrating a method of detecting high temperature abnormal according to a third embodiment of the present invention.

Now, a third embodiment is described with reference to FIG. 10. Outline configurations of an image forming apparatus and a fixing device are the same as those of the first embodiment shown in FIGS. 1 to 4.

An inclination of rising of temperature (i.e., a temperature rising amount per hour) of the fixing belt due to heating of the heater varies depending on a rotating or stopping condition of the fixing belt. Specifically, the temperature rising inclination tends to be relatively smaller when the fixing belt rotates, such as when it is in warm up and fixing operation execution conditions. Whereas the temperature rising inclination is relatively larger when the fixing belt stops rotating such as when it is in the waiting time condition.

As mentioned with reference to FIG. 6, each of temperature rising amounts of delta Tin and delta Tout is detected in a prescribed detection time periods delta $t_1$ and $t_2$ in the third embodiment. When the temperature rising inclination of the fixing belt is large, temperature of the fixing belt excessively rises and possibly reaches the damaging level during the time period for detecting the temperature rising amount. Thus, at the time of stopping the fixing belt and accordingly the temperature rising inclination is large (i.e. sharp), the above-mentioned detection time periods delta $t_1$ and $t_2$ when the above-mentioned temperature rising amounts of delta Tin and delta Tout are detected are decreased.

Similar to the second embodiment, it is determined if the temperature rising amounts delta Tin and delta Tout obtained in the prescribed times delta $t_1$ and delta $t_2$ exceed the first or second temperature rising amount thresholds delta T1 and delta T2, respectively. However, when the temperature rising inclination of the fixing belt is small (i.e. dull) and high temperature abnormality occurs, temperature rising amount does not exceed the first and second temperature rising amount thresholds delta T1 and delta T2 in a prescribed time period, thereby being incapable of detecting the high temperature abnormality. Thus, at the time of rotating of the fixing belt, and accordingly temperature rising inclination of the fixing belt is small, the first and second temperature rising amount thresholds delta T1 and delta T2 are decreased less than those at the time of stopping thereof and thereby the temperature rising inclination is large.

As shown in a table 2, exemplary temperature rising inclinations of the fixing belt during its stopping and rotation conditions, and detection time periods delta $t_2$ and second temperature rising amount thresholds delta T2 each designated in accordance with the temperature rising inclinations are listed.

Table 2 (See FIG. 21)

An amount of the temperature rising inclination changes in accordance with a configuration of the fixing device. Accordingly, detection time periods delta $t_1$ and $t_2$ and first and second temperature rising amount thresholds delta T1 and delta T2 in stopping and rotation conditions are preferably adjusted in accordance with the temperature rising inclination. Such information table is preferably stored in the first and second high temperature abnormality detecting sections 311 and 312.

Now, an exemplary sequence of detecting high temperature abnormality in this embodiment is described with reference to FIG. 10, wherein steps 11 to 20 are the same as the sequence described with reference to FIG. 9.

When temperature of the fixing belt reaches the first high temperature detection limit in step S11, a temperature rising amount is detected in a prescribed detection time period in step S12. Different from the second embodiment, precedent to the above-mentioned steps, the above-mentioned detection time period and the temperature rising amount threshold are selected by a controller in accordance with rotating and stopping conditions of the fixing belt in step S30. Then, the temperature rising amount is detected in the selected detection time period in step S12. It is then determined if such detected temperature rising amount exceeds the selected first temperature rising amount threshold in step S13.

Further, a temperature rising amount is detected in a prescribed detection time period in step S15 after the temperature of the fixing belt reaches the second high temperature detection limit in step S14. A prescribed detection time and a second temperature rising amount threshold are selected in accordance with rotating and stopping conditions of the fixing belt in step S40. Then, the temperature rising amount is detected in the selected detection time period in step S15. Then, it is determined if such detected temperature rising amount exceeds the selected second temperature rising amount threshold in step S16. The rest of high temperature abnormality detection is similarly executed as in the second embodiment.

Further, only one of the detection time periods and the first temperature rising amount threshold (or the second temperature rising amount threshold) can be selected in accordance with rotation and stop conditions of the fixing belt.

According to the third embodiment, since prescribed detection time periods delta $t_1$ and $t_2$ are decreased when temperature rising inclination is larger than when temperature rising inclination is small, high temperature abnormality can be detected and generation of heat by the heat generating device can be stopped at an appropriate time. Further, since the first and second temperature rising amount threshold delta T1 and T2 are minimized when the fixing belt rotates and the temperature rising inclination thereof is small than when the fixing belt stops and the temperature rising inclination thereof is large, the high temperature abnormality can be reliably detected without overlooking.

Figure 11:
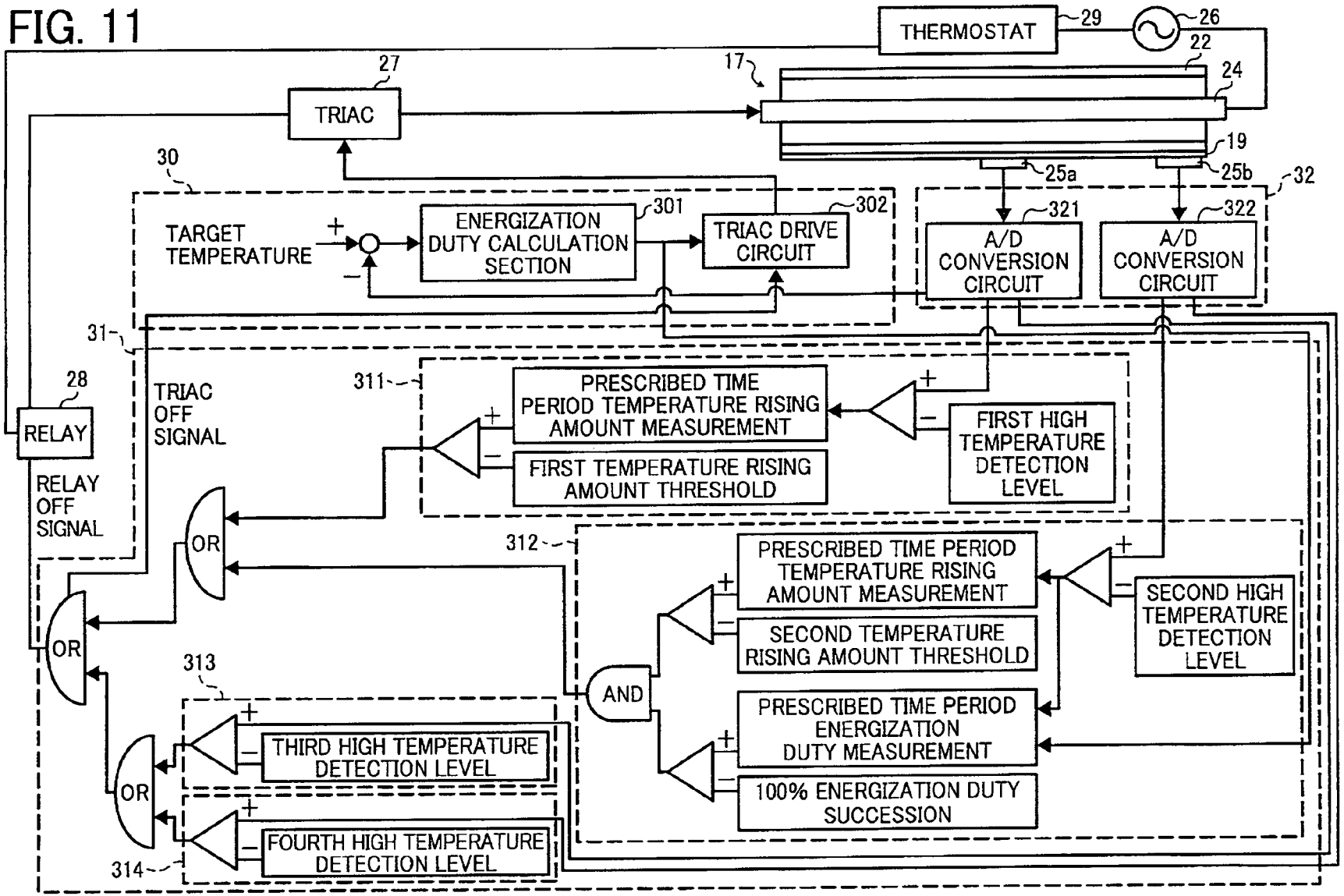
FIG. 11 is a block chart illustrating a control system for the fixing device according to a fourth embodiment of the present invention.

Now, the fourth exemplary embodiment is described with reference to FIG. 11. Outline configurations of an image forming apparatus and a fixing device are similar to those of the first embodiment shown in FIGS. 1 to 3, except for a control system as follows.

Initially, an exemplary control system of the fixing device is described with reference to FIG. 11. As shown, the high temperature abnormality detecting section 31 includes a third high temperature abnormality detecting section 313 for detecting high temperature abnormality based on temperature information detected by an internal temperature detection section 25*a*, and a fourth high temperature abnormality detecting section 314 for detecting high temperature abnormality based on temperature information detected by an external temperature detection section 25*b*.

The third high temperature abnormality detecting section 313 is connected to the internal temperature detection section 25*a* via the A/D conversion circuit 321 included in a detection signal processing section 32. Thus, a temperature detection signal detected by the internal temperature detection device 25*a* is subjected to digital conversion by the A/D conversion circuit 321 and is inputted to the third high temperature abnormality detecting section 313. The third high temperature abnormality detecting section 313 stores a third high temperature detection limit as a reference for detecting high temperature abnormality.

The fourth high temperature abnormality detecting section 314 is connected to the external temperature detection device 25*d* via the A/D conversion circuit 322 included in a detection signal processing section 32. Thus, a temperature detection signal detected by the external temperature detection device 25*b* is subjected to digital conversion by the A/D conversion circuit 322 and is inputted to the fourth high temperature abnormality detecting section 313. The fourth high temperature abnormality detecting section 314 stores a fourth high temperature detection limit as a reference for detecting high temperature abnormality.

Now, an exemplary relation between the third and fourth high temperature detection limits T3 and T4 and temperatures detected by the internal and external temperature detection devices 25*a* and 25*b*, respectively, are typically described with reference to FIG. 12, wherein a left side vertical axis represents a temperature detected by the internal temperature detection device 25*a* and a right side vertical axis represents a temperature detected by the external temperature detection device 25*b*.

As shown, the third high temperature detection limit T3 is lower than a damaging temperature $T_{D\text{-}IN}$ detectable for the internal temperature detection device 25*a* and higher than the first high temperature detection limit T1. Further, the fourth high temperature detection limit T4 is lower than a damaging temperature $T_{D\text{-}OUT}$ detectable for the external temperature detection device 25*b* and higher than the second high temperature detection limit T2.

When paper jam occurs, a drive of the fixing device and power distribution to the heater are forcibly stopped. However, temperature of the fixing belt rises due to transmission of heat from the heater to the fixing belt for a while after the stop of power distribution to the heater. So as not to erroneously detect such temperature rise of the fixing belt as high temperature abnormality caused by abnormality, such as paper jam, etc., the third and fourth high temperature detection limits T3 and T4 are set higher than the maximum level at which the fixing belt arrives after the stop of driving of the fixing device.

Figure 12:
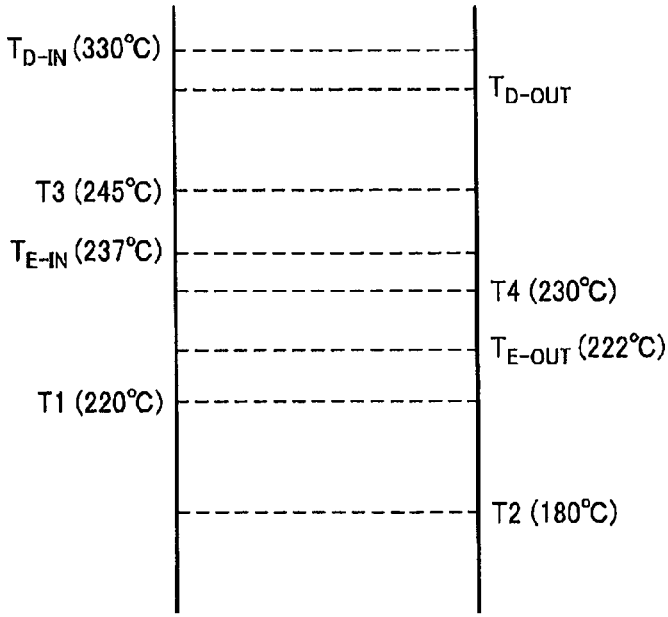
FIG. 12 is a chart schematically illustrating a relation between designated third and fourth high temperature detection limits and temperatures detected by the internal and external temperature detection devices.

Specifically, as shown in FIG. 12, when the drive of the fixing device is stopped due to abnormality, such as paper jam, etc., the maximum arrival temperature $T_{E\text{-}IN}$ detected by internal temperature detection device 25*a* thereafter is 237 degree centigrade, and the maximum arrival temperature $T_{E\text{-}OUT}$ detected by external temperature detection device 25*b* is 222 degree centigrade. Accordingly, the third high temperature detection limit T3 is set to 245 degree centigrade higher than the maximum arrival temperature $T_{E\text{-}IN}$ of 237 degree centigrade detected by the internal temperature detection device 25*a*, and the fourth high temperature detection limit T4 is set to 230 degree centigrade higher than the maximum arrival temperature $T_{E\text{-}OUT}$ of 222 degree centigrade detected by the external temperature detection device 25*b*.

Figure 13:
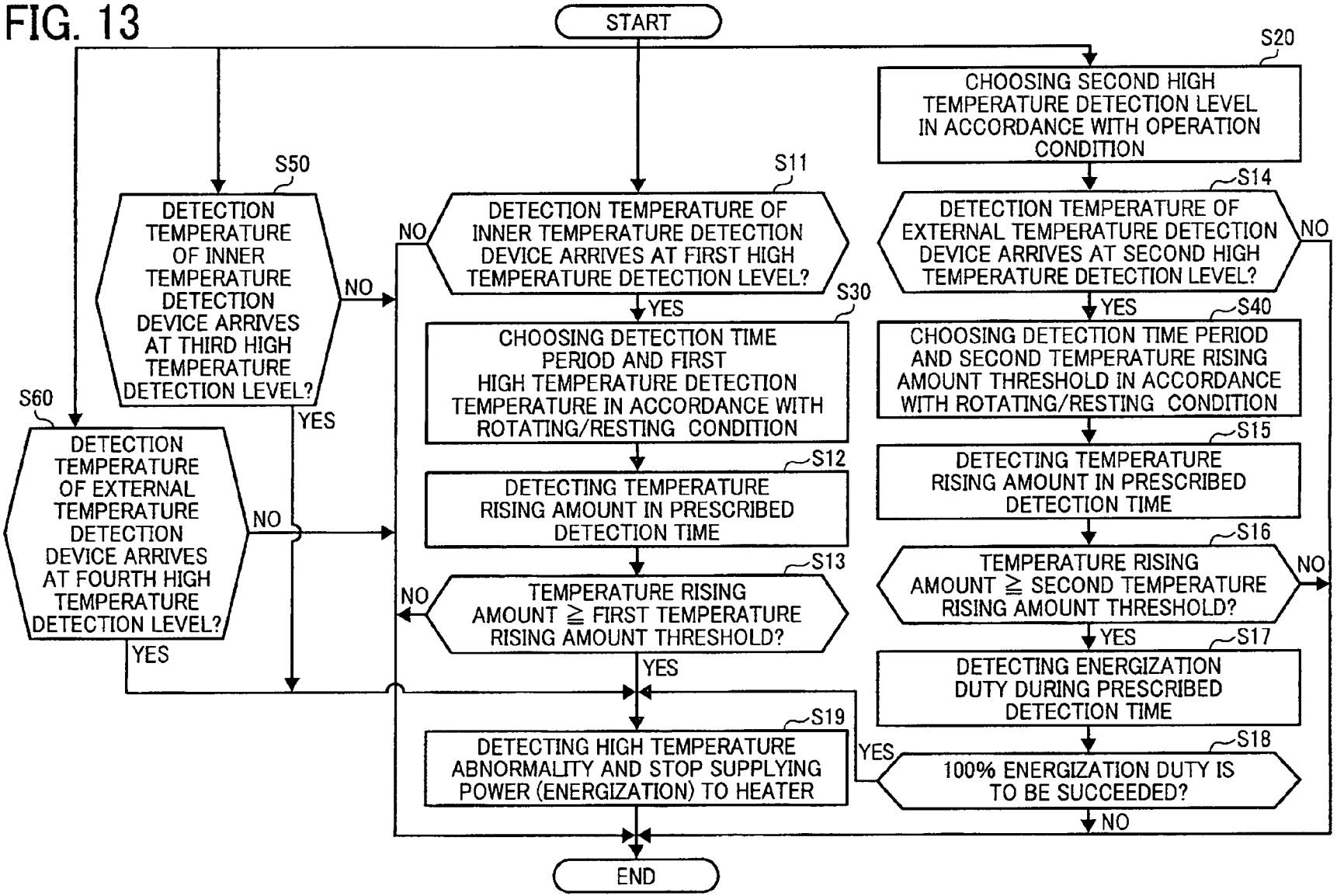
FIG. 13 is a flowchart illustrating a method of detecting high temperature abnormal according to the fourth embodiment of the present invention.

Now, an exemplary sequence of the fourth embodiment is described with reference to FIG. 13.

The high temperature abnormality detection method of this embodiment is different from that of the third embodiment as follows. As shown, in parallel to step S11 or S14 for detecting if temperature of the fixing belt reaches the first or the second high temperature detection limits, steps S50 and S60 for detecting if temperature of the fixing belt reaches the third or fourth high temperature detection limit is executed.

Specifically, temperature information is detected by the internal temperature detection device 25*a* and is inputted to the third high temperature abnormality detecting section 313. Then, the third high temperature abnormality detecting section 313 determines if the detection temperature reaches the third high temperature detection limit in step S50. When the detection temperature does not arrive at the third high temperature detection limit, it is determined as not being the high temperature abnormality and power distribution to the heater 24 is not stopped. Whereas when it is determine that the detection temperature has arrived at the third high temperature detection limit, it is determined as being the high temperature abnormality and a signal for turning off the triac 27 and the relay 28 is transmitted from the third high temperature abnormality detecting section 313, while the power distribution to the heater 24 is stopped in step S19.

The temperature information detected by the external temperature detection device 25*b* is inputted to the fourth high temperature abnormality detecting section 314. Then, the fourth high temperature abnormality detecting section 314 determines if the detection temperature reaches the fourth high temperature detection limit in step S60. When the detection temperature does not reaches the fourth high temperature detection limit, it is determined as not being the high temperature abnormality and power distribution to the heater 24 is not stopped. Whereas when it is determined that the detection temperature has arrived at the fourth high temperature detection limit, it is determined as being the high temperature abnormality and a signal for turning off the triac 27 and the relay 28 is transmitted from the fourth high temperature abnormality detecting section 314, while the power distribution to the heater 24 is stopped in step S19. The rest of the sequence of detecting the high temperature abnormality is similarly executed as in the third embodiment.

In this high temperature abnormality detection, a temperature rising amount is detected in a prescribed time period in each of steps S12 and S15 and the thus detected temperature rising amount is determined as exceeding the first or the second temperature rising amount threshold in each of steps S13 and S16. However, when temperature of the fixing belt sharply rises in a prescribed detection time period, the temperature possibly reaches the damaging level. When the temperature of the fixing belt gradually rises, and accordingly, the temperature rising amount does not exceed one of the first and second temperature rising amount thresholds in the prescribed detection time periods, it is not detected nor regarded as being the high temperature abnormality. When further continuously increased, the temperature of the fixing belt possibly reaches the damaging level.

However, since the third and fourth high temperature detection limits are designated as above, temperature abnormality can be detected when temperature of the fixing belt arrives at one of the third and fourth high temperature detection limits even though it either sharply or gradually rises. As a result, the temperature of the fixing belt can be avoided from reaching the damaging level.

Further, so as not to erroneously detect temperature rise of the fixing belt as high temperature abnormality caused by abnormality, such as paper jam, etc., the third and fourth high temperature detection limits T3 and T4 are set higher than the maximum temperature at which the fixing belt arrives after the stop of driving the fixing device. Thus, temperature is not erroneously detected as high temperature abnormality after the abnormality is resolved, and accordingly, driving of the fixing device is safely resumed.

Further, the temperature of the fixing belt rises due to transmission of heat from the heater for a while after high temperature abnormality is detected and power distribution to the heater is stopped. Then, the third and fourth high temperature detection limits T3 and T4 are preferably set to prescribed levels so that the maximum arrival temperature of the fixing belt by the heat of the heater does not exceed the damaging level after stop of power distribution to the heater.

Figure 14:
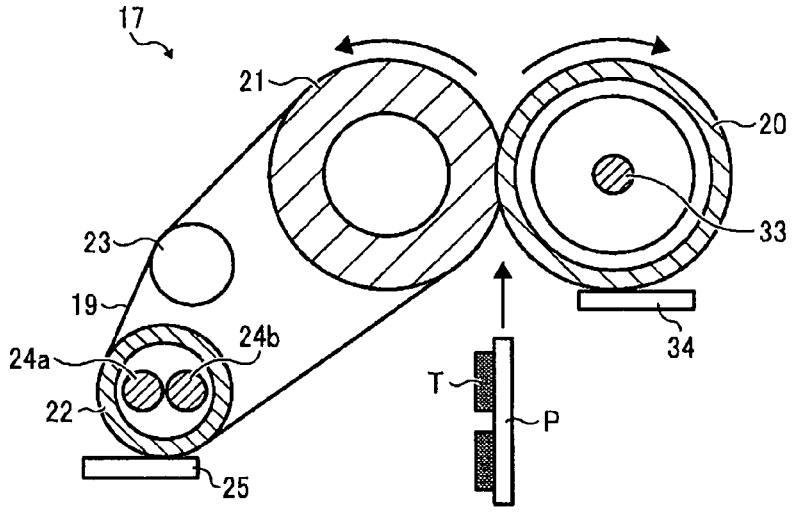
FIG. 14 is a schematic cross sectional view illustrating the fixing device including a heating roller having a pair of heaters.

Now, another exemplary fixing device is described with reference to FIG. 14. As shown, as similar to that described with reference to FIG. 2, a fixing belt 19, a fixing roller 21, a heating roller 22, plural suspension rollers 23, and a pressurizing roller 20 or the like are included in the fixing device. However, a pair of heaters 24*a* and 24*b* is arranged in the heating roller 22. The heat applying roller 20 also includes a heater 33. A temperature detection device 25 is arranged on the outer circumferential surface of the fixing belt 19 opposing the heating roller 22 to detect temperature of the fixing belt 19. A temperature detection device 34 is also arranged on the outer circumferential surface of the pressurizing roller 20 to detect temperature of the pressurizing roller 20.

Figure 15:
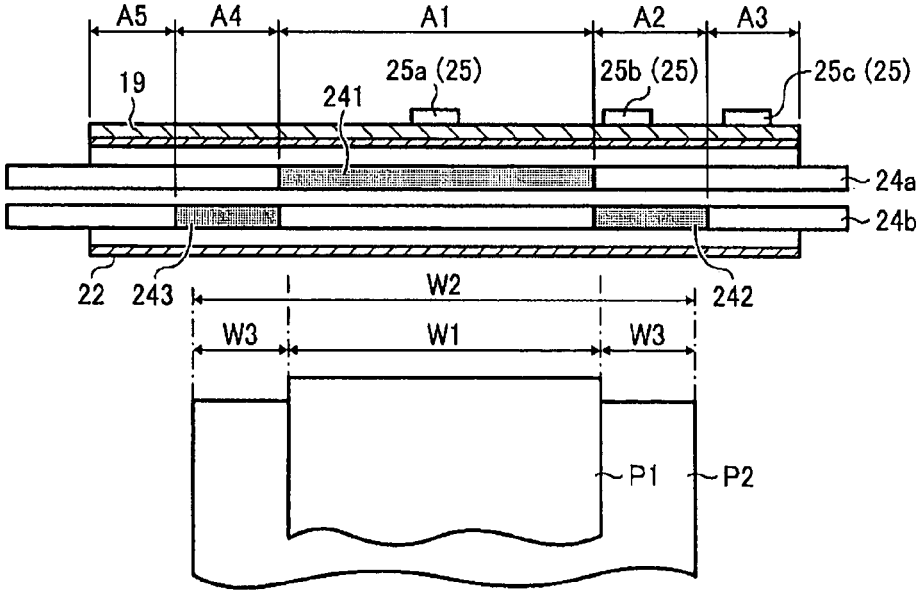
FIG. 15 is a schematic cross sectional view illustrating the heating roller of FIG. 14.

The heating roller 22 is now described more in detail with reference to FIG. 15. As shown, the heater 24*a* arranged in the upper portion of the drawing includes a first heat generation section 241 at a center in its axial direction. The lower side heater 24*b* includes second and third heat generation sections 242 and 243 being separated from each other. These three heat generation sections 241 to 243 are arranged in the different regions in the widthwise direction of the rotation plane of the fixing belt not to overlap with each other The fixing device is enabled to fix two types of printing mediums P1 and P2 having a different width from each other when they pass through passage regions W1 and W2 for these printing mediums P1 and P2 as shown in FIG. 15. Although these different width printing mediums are conveyed with reference to the common center in the widthwise direction as shown, they can be conveyed with reference to a common side end thereof.

The first heat generation section 241 is arranged corresponding to the narrower passage region W1, while the second and third heat generation sections 242 and 243 are arranged corresponding to the region W3 included in the broader passage region W2 not to overlap with the narrower passage region W1.

When fixing the printing medium P1 having the narrower width by applying heat to the passage region W1, only the upper side heater 24*a* is supplied with power and the first heat generation section 241 is heated. Whereas, when fixing a printing medium P2 having the broader width and applying heat to all of the passage region W2, both heaters 24*a* and 24*b* are supplied with power, whereby three heat generation sections 241 to 243 are heated.

The temperature detection device 25 includes first to third temperature detection members 25*a* to 25*c*. The first temperature detection member 25*a* is arranged within a region A1 located corresponding to the first heat generation section 241. The second temperature detection member 25*b* is arranged within a region A2 located corresponding to the second heat generation section 242. The third temperature detection member 25*c* is arranged within a region A3 located not corresponding to these three heat generation sections 241 to 243. However, the second temperature detection member 25*b* can be arranged within a region A4 located corresponding to the third heat generation section 243, while the third temperature detection member 25*c* can be arranged within another region A5 not corresponding to these three heat generation sections 241 to 243.

In case that the above-mentioned pair of heaters 24*a* and 24*b* are employed, high temperature abnormality can also be detected using any one of the fixing device control systems of the above-mentioned various embodiments. Specifically, the first temperature detection member 34*a* is regarded as the internal temperature detection device and the second temperature detection member 24*b* is regarded as the external temperature detection device for the first heat generation section 241. Similarly, the second temperature detection member 25*b* is regarded as the internal temperature detection device and the third temperature detection member 25*c* is regarded as the external temperature detection device for the second heat generation section 242.

Figure 16:
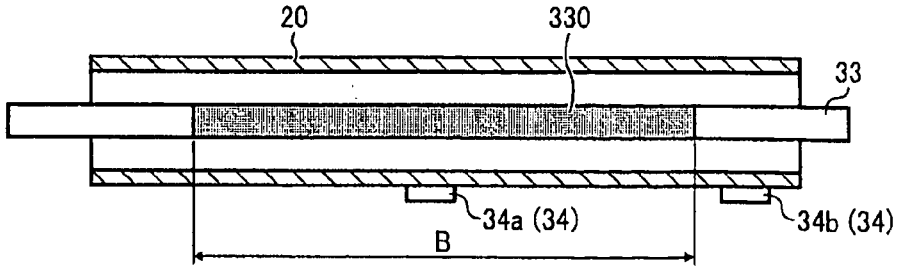
FIG. 16 is a schematic cross sectional view illustrating a pressurizing roller of the fixing device of FIG. 14.

The pressurizing roller 20 is now described more in detail with reference to FIG. 16. As shown, the heater 33 installed in the pressurizing roller 20 includes a heat generation section 330 arranged in the widthwise direction of the rotation plane of the pressurizing roller 20. The temperature detection device 34 detecting temperature of the pressurizing roller 20 includes a first temperature detection member 34*a* arranged within a region B located corresponding to the heat generation section 330 and a second temperature detection member 34*b* arranged corresponding to the outside of the region B.

In case that the heater 33 is installed in the pressurizing roller 20, high temperature abnormality thereof can be detected using each of the fixing devices control systems of the above-mentioned various embodiments. Specifically, the first temperature detection member 34*a* serves as the internal temperature detection device while the second temperature detection member 34*b* serves as the external temperature detection device.

A fixing device capable of adopting the control method of the above-mentioned various embodiments of the present invention is not limited. Specifically, the control system can be applied to the other types as shown in FIGS. 17 to 20 as described below in detail.

Figure 17:
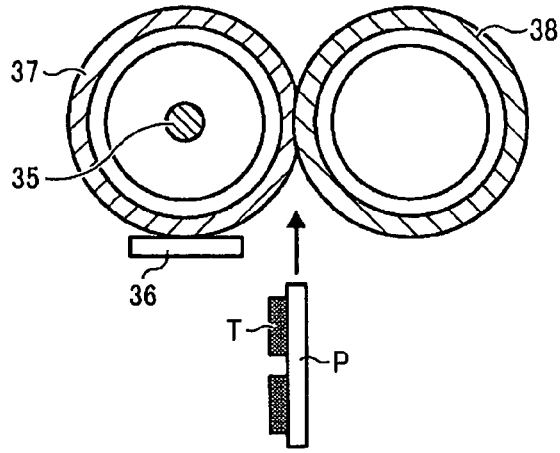
FIG. 17 is a schematic cross sectional view illustrating a fixing device employing a fixing roller.

For example, a fixing device of FIG. 17 includes a fixing roller 37 having a heater 35 and a pressurizing roller 38 pressure contacting the fixing roller 37. The fixing device employs a fixing roller 37 as a fixing device instead of the fixing belt. A driving device, not shown, drives the fixing roller 37. The pressurizing roller 38 is driven at the same speed as the fixing roller 37. A toner image T not fixed onto the printing medium P is fixed by conveying the printing medium P through a fixing nip where the fixing roller 37 and the pressurizing roller 38 pressure-contact each other. The fixing device is configured to similarly detect temperature of the fixing roller 37 using a temperature detection device having internal and external temperature detection members as the above-mentioned several embodiments.

Figure 18:
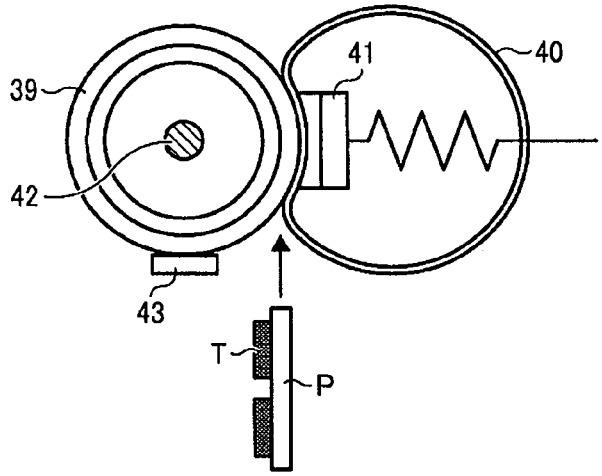
FIG. 18 is a schematic cross sectional view illustrating a fixing device employing a pressurizing belt.

The fixing device of FIG. 18 includes a fixing roller 39 having a heater 42 and an endless pressurizing belt 40 applying pressure to the fixing roller 39. The pressurizing belt 40 is biased by a pressurizing pad 41 to pressure-contact the fixing roller 39 and is driven at the same speed as the fixing roller 39. A toner image T on the printing medium P is fixed by conveying the printing medium P through a fixing nip created between the fixing roller 39 and the pressurizing belt 40. The fixing device is configured to similarly detect temperature of the fixing roller 39 using a temperature detection device 43 having internal and external temperature detection members as the above-mentioned several embodiments.

Figure 19:
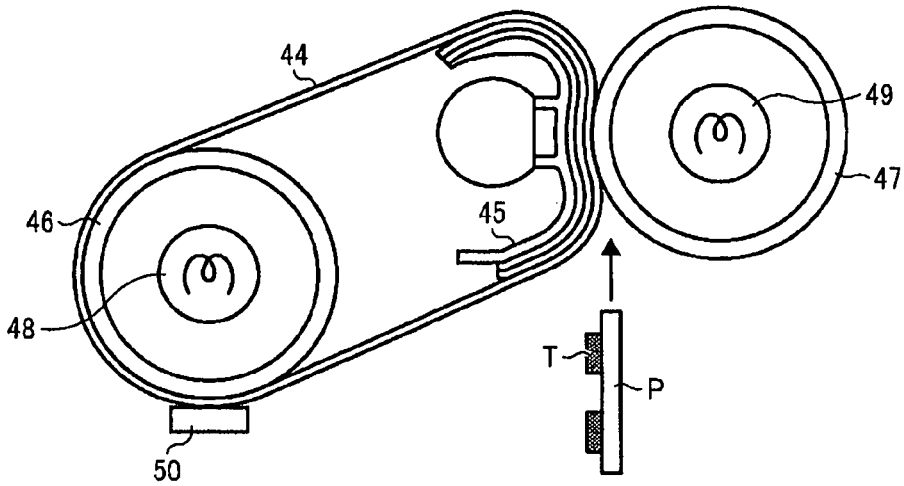
FIG. 19 is a schematic cross sectional view illustrating a fixing device employing a fixing pad.

The fixing device of FIG. 19 includes a fixing roller 46 installing a heater 48, a fixing pad 45, a fixing belt 44 suspended by the fixing pad 45 and the heating roller 46, and a pressurizing roller 47 installing a heater 49 and pressure-contacting the fixing belt 44 at a position opposing the fixing pad 45. The fixing belt 44 is driven rotated as the pressurizing roller 47 rotates. A toner image T on the printing medium P is fixed by conveying the printing medium P through a fixing nip created by the fixing belt 44 and the pressurizing roller 47 pressure-contacting the fixing belt 44. The fixing device similarly detests temperature of the fixing belt 44 using a temperature detection device 50 having an internal temperature detection member and an external temperature detection member.

A fixing device of FIG. 20 includes a fixing belt 51 wound around a pair of rollers 52 and 53 as well as a guide member 54, and a pressurizing belt 55 wound around a pair of rollers 56 and 57 as well as a guide member 57. The fixing belt 51 is driven rotated by a roller 52 driven by a drive section, not shown. The pressurizing belt 55 is biased by a roller 56 to pressure contact the fixing belt 51 and is driven at the same speed as the rotating fixing belt 51. The pair of rollers 52 and 56 includes heaters 59 and 60, and heats the fixing belt 51 and the pressurizing belt 55, respectively. A toner image T on the printing medium P is fixed by conveying the printing medium P through a fixing nip where the fixing belt 51 and the pressurizing belt 55 pressure-contact each other. The fixing device is configured to similarly detect temperature of the fixing belt 51 using a temperature detection device 61 having internal and external temperature detection members as described in the above-mentioned several embodiments.

Obviously, numerous additional modifications and variations of the present invention are possible in light of the above teachings. It is therefore to be understood that within the scope of the appended claims, the present invention may be practiced otherwise than as specifically described herein.

Advantage

According to one embodiment of the present invention, high temperature abnormality is reliably detected and an operation of a heat generating device can be stopped avoiding erroneous detection during a normal operation. Further, when it is impossible for a first high temperature abnormality detecting section to detect high temperature abnormality due to occurrence of accident in its internal temperature detection device or the like, a second high temperature abnormality detecting section is enabled to detect the high temperature abnormality. Thus, a highly reliable fixing device and an image forming apparatus can be provided without a problem caused by the high temperature abnormality.

What is claimed is:

1. A fixing apparatus, comprising:

a rotatable fixing device configured to fix a toner image onto a printing medium with heat and pressure at a pressure contacting section;

a heat generating device configured to generate and apply heat to the fixing device, said heat generating device having at least one heat generation section extending in a widthwise direction of the fixing device;

a pressurizing device configured to pressure contact the fixing device at the pressure contacting section;

an internal temperature detection device arranged within a heat generation region corresponding to the at least one heat generation section and configured to detect temperature of the fixing device;

an external temperature detection device arranged at the outside of the heat generation region and configured to detect temperature of the fixing device; and a temperature control device configured to control the heat generating device to approximate the temperature of the fixing device to a target level based on the temperature detected by the internal temperature detection device;

wherein heat generation of the heat generating device is stopped one of when temperature detected by the internal temperature detection device reaches a prescribed first high temperature detection limit and a temperature rising amount in a prescribed time period after the first high temperature detection limit is reached exceeds a prescribed threshold, and when temperature detected by the external temperature detection device reaches a prescribed second high temperature detection limit, a temperature rising amount detected in a prescribed time period after the second high temperature detection limit is reached exceeds a prescribed threshold, and the heat generating device continuously generates heat on a maximum heat generation condition for a prescribed time period within the second prescribed time period;

wherein said second high temperature detection limit is different than the first high temperature detection limit, and wherein said second high temperature detection limit is automatically changed in accordance with a status of the fixing device.

2. The fixing apparatus as claimed in claim 1, wherein said heat generating device is controlled to adjust a ratio of a power distribution time period to an hour when the power is distributed to the heat generating device, and wherein said maximum heat generation condition is created by 100% of the power distribution duty.

3. The fixing apparatus as claimed in claim 1, wherein said status including warm up, waiting time, and fixing operation execution steps, and wherein the below described inequality is established, wherein T2*a*, T2*b*, and T2*c* represent second high temperature detection limits for the warm up, waiting time, and fixing operation execution steps, respectively:

$$T2a<T2b<T2c.$$

4. The fixing apparatus as claimed in claim 1, wherein said prescribed detection time periods are automatically decreased when the fixing device is stopping.

5. The fixing apparatus as claimed in claim 1, wherein said thresholds are decreased when the fixing device is rotating.

6. The fixing apparatus as claimed in claim 1, wherein said first and second high temperature detection limits are determined so that a maximum temperature at which the fixing device arrives with heat transmitted from the heat generating device after the heat generation is stopped does not cause nonreversible damage on the fixing device.

7. The fixing apparatus as claimed in claim 1, wherein the first high temperature detection limit is higher than the maximum temperature detected by the internal temperature detection device during the normal operation of the fixing device.

8. The fixing apparatus as claimed in claim 1, wherein said second high temperature detection limit is lower than the maximum temperature detected by the external temperature detection device during the normal operation of the fixing device.

9. The fixing apparatus as claimed in claim 1, wherein a third high temperature detection limit is set higher than the first high temperature detection limit, and a fourth high temperature detection limit is set higher than the second high temperature detection limit; and wherein heat generation of the heat generating device is stopped one of when temperature detected by the internal temperature detection device reaches the third high temperature detection limit, and when temperature detected by the external temperature detection device reaches the fourth high temperature detection limit.

10. The fixing apparatus as claimed in claim 9, wherein the third and fourth high temperature detection limits are determined so that the maximum temperature at which the fixing device arrives with heat transmitted from the heat generating device after the heat generation is stopped does not cause nonreversible damage on the fixing device.

11. The fixing apparatus as claimed in claim 9, wherein the third high temperature detection limit is higher than maximum temperature detected by the internal temperature detection device after the heat generation is stopped, and wherein the fourth high temperature detection limit is higher than maximum temperature detected by the external temperature detection device after the heat generation is stopped.

12. The fixing apparatus as claimed in claim 1, wherein said at least one heat generating section includes first and second heat generation sections arranged in different regions in a widthwise direction of the fixing device, further comprising;

a first temperature detection device arranged within a region located corresponding to the first heat generation section;

a second temperature detection device arranged within a region located corresponding to the second heat generation section; and a third temperature detection device arranged in a region located not corresponding to each of the first and second heat generation sections;

wherein the first temperature detection device serves as the internal temperature detection device and the second temperature detection device serves as the external temperature detection device each for the first heat generation section, and wherein the second temperature detection device serves as the internal temperature detection device and the third temperature detection device serves as the external temperature detection device each for the second heat generation section.

13. A method of fixing a toner image on a printing medium by conveying the printing medium through a pressure contact section under heat and pressure, said method comprising:

heating a fixing device;

applying pressure to the fixing device at the pressure contact section;

arranging an internal temperature detection device within a widthwise region corresponding to the heat generation section;

detecting temperature of the fixing device using the internal temperature detection device;

arranging an external temperature detection device at the outside of the widthwise region;

detecting temperature of the fixing device using the external temperature detection device;

controlling the heat generating device to approximate the temperature of the fixing device to a target level; and stopping heat generation of the heat generating device one of when the temperature reaches the first high temperature detection limit and a temperature rising amount exceeds a prescribed threshold in a prescribed time period after the first high temperature detection limit is reached, and when the temperature reaches a prescribed second high temperature detection limit, a temperature rising amount in a second prescribed time period after the second high temperature detection limit is reached exceeds a prescribed threshold, and the heat generating device continuously generates heat on the maximum heat generation condition for a prescribed time period within the second prescribed time period, wherein said second high temperature detection limit is automatically changed in accordance with a status of the fixing device.

14. An image forming system including the fixing apparatus as claimed in claim 1.

15. A fixing apparatus, comprising:

a rotatable fixing device configured to fix a toner image onto a printing medium with heat and pressure at a pressure contacting section;

a heat generating device configured to generate and apply heat to the fixing device, said heat generating device having at least one heat generation section extending in a widthwise direction of the fixing device;

a pressurizing device configured to pressure contact the fixing device at the pressure contacting section;

an internal temperature detection device arranged within a heat generation region corresponding to the at least one heat generation section and configured to detect temperature of the fixing device;

an external temperature detection device arranged at the outside of the heat generation region and configured to detect temperature of the fixing device; and a temperature control device configured to control the heat generating device to approximate the temperature of the fixing device to a target level based on the temperature detected by the internal temperature detection device;

wherein heat generation of the heat generating device is stopped one of when temperature detected by the internal temperature detection device reaches a prescribed first high temperature detection limit and a temperature rising amount in a prescribed time period after the first high temperature detection limit is reached exceeds a prescribed threshold, and when temperature detected by the external temperature detection device reaches a prescribed second high temperature detection limit, a temperature rising amount detected in a prescribed time period after the second high temperature detection limit is reached exceeds a prescribed threshold, and the heat generating device continuously generates heat on a maximum heat generation condition for a prescribed time period within the second prescribed time period, wherein said second high temperature detection limit is different than the first high temperature detection limit, and wherein said second high temperature detection limit is lower than the maximum temperature detected by the external temperature detection device during a normal operation of the fixing device.

* * * * *